US010046885B2

(12) United States Patent
Sonntag et al.

(10) Patent No.: US 10,046,885 B2
(45) Date of Patent: Aug. 14, 2018

(54) SPIGOT AND SPIGOT GUARD FOR AN INSULATING CONTAINER

(71) Applicant: YETI Coolers, LLC, Austin, TX (US)

(72) Inventors: James William Sonntag, Austin, TX (US); Christopher M. Keller, Austin, TX (US); Steve Charles Nichols, Austin, TX (US); Roy Joseph Seiders, Rollingwood, TX (US); David J. Bell, Austin, TX (US)

(73) Assignee: YETI Coolers, LLC, Austin, TX (US)

( * ) Notice: Subject to any disclaimer, the term of this patent is extended or adjusted under 35 U.S.C. 154(b) by 0 days.

(21) Appl. No.: 15/296,557

(22) Filed: Oct. 18, 2016

(65) Prior Publication Data

US 2017/0305605 A1 Oct. 26, 2017

Related U.S. Application Data

(63) Continuation-in-part of application No. 15/133,393, filed on Apr. 20, 2016.

(51) Int. Cl.
*F17C 1/02* (2006.01)
*B65D 25/48* (2006.01)
(Continued)

(52) U.S. Cl.
CPC ..... *B65D 25/48* (2013.01); *B65D 25/2808* (2013.01); *B65D 81/3818* (2013.01);
(Continued)

(58) Field of Classification Search
CPC ..... B65D 81/38–81/3818; B65D 25/28–25/2808; B65D 2525/281
(Continued)

(56) References Cited

U.S. PATENT DOCUMENTS 1,565,686 A 12/1925 Titus
2,070,488 A 2/1937 McIntosh
(Continued)

FOREIGN PATENT DOCUMENTS

DE 10210055 A1 10/2003
DE 102004041583 A1 3/2006
(Continued)

OTHER PUBLICATIONS

Sep. 29, 2017—(PCT) ISR & Written Opinion—App PCT/U52017/028288.
(Continued)

*Primary Examiner* — Kareen Thomas
(74) *Attorney, Agent, or Firm* — Banner & Witcoff, Ltd.

(57) ABSTRACT

An insulating container having a base and a lid is provided. The lid may be rotatable about a hinge from a closed configuration to an open configuration and may be secured, via one or more latching devices, in either the closed configuration or the open configuration. In some examples, the rotatable lid may be non-destructively removable from the base. Some example arrangements include a removable lid that, when removed, may be secured to the base via an additional portion of the latching device. Additional features of the insulating container include handles that are integrally formed with the base, a recess formed in the base and housing a spigot, and/or a spigot guard.

19 Claims, 28 Drawing Sheets

(51) Int. Cl.
*B65D 25/28* (2006.01)
*B65D 81/38* (2006.01)
*B67D 3/04* (2006.01)

(52) U.S. Cl.
CPC ..... *B65D 81/3823* (2013.01); *B67D 3/04* (2013.01); *B65D 2525/281* (2013.01)

(58) Field of Classification Search
USPC ..... 220/592.2–592.27, 724, 728, 908–911
See application file for complete search history.

(56) References Cited

U.S. PATENT DOCUMENTS 2,628,062 A 2/1953 Weber
3,111,014 A 11/1963 Herrick
3,439,835 A 4/1969 Reid
3,592,359 A 7/1971 Marraffino
3,863,673 A 2/1975 Sitton
3,923,949 A 12/1975 Kane et al.
D248,440 S 7/1978 Bryan et al.
4,162,029 A 7/1979 Gottsegen et al.
D253,369 S 11/1979 Koelble et al.
4,181,243 A 1/1980 Frahm
D261,391 S 10/1981 Ranua et al.
4,351,455 A 9/1982 Bond
4,367,572 A 1/1983 Zielenski
D270,704 S 9/1983 Ruxton et al.
4,440,316 A 4/1984 Christine
4,742,851 A 5/1988 Lundblade
4,805,859 A 2/1989 Hudson
4,936,409 A 6/1990 Nix et al.
5,165,645 A 11/1992 Brown
5,222,631 A 6/1993 Hood
D365,747 S 1/1996 Grande
D368,129 S 3/1996 Peeples
5,535,883 A 7/1996 Henderson
5,607,084 A 3/1997 George
5,827,023 A 10/1998 Stull
5,913,448 A 6/1999 Mann et al.
5,971,218 A 10/1999 Le
6,059,143 A 5/2000 Weir
6,102,356 A 8/2000 Huntley et al.
6,105,844 A 8/2000 Walters et al.
6,126,046 A 10/2000 Baculy
6,126,124 A 10/2000 Wagner
6,176,562 B1 1/2001 Hart
6,302,051 B1 10/2001 Hemmingson
D451,765 S 12/2001 Israel et al.
6,386,557 B1 5/2002 Weldon
6,401,752 B1 6/2002 Blackbourn et al.
6,405,557 B1 6/2002 DeCastro et al.
6,427,886 B1 8/2002 Essex
D468,071 S 12/2002 Le et al.
6,491,189 B2 12/2002 Friedman
6,527,153 B1 3/2003 Manos
D472,762 S 4/2003 Song
6,564,893 B2 5/2003 Lipman
6,666,362 B1 12/2003 LeTrudet
6,755,428 B2 6/2004 Butler
6,845,786 B1 1/2005 Ophardt et al.
D504,713 S 5/2005 Py et al.
6,896,158 B2 5/2005 Leray et al.
D528,368 S 9/2006 Maldonado
D546,119 S 7/2007 Dodge
7,269,969 B2 9/2007 Strickland et al.
7,311,229 B1 12/2007 Wrigley
7,328,818 B2 2/2008 Prabucki
7,331,559 B2 2/2008 Hirayu
D566,479 S 4/2008 Kabalin
D571,188 S 6/2008 Brassard
7,455,281 B2 11/2008 Craft
7,669,828 B2 3/2010 Hardy et al.
7,802,709 B1 9/2010 Lewis et al.
D626,406 S 11/2010 Tedesco et al.
7,841,635 B2 11/2010 Fuchs
D628,566 S 12/2010 Molter
D648,006 S 11/2011 Morishita
8,123,236 B1 2/2012 Helenihi
D662,572 S 6/2012 Marquis-Martin
8,230,697 B2 7/2012 Lavallee
D693,220 S 11/2013 Luo
D695,568 S 12/2013 Hayes
8,746,498 B2 6/2014 Maldonado et al.
8,827,230 B2 9/2014 Nemoto
8,950,989 B1 2/2015 Rivera
9,057,552 B2 6/2015 Vanderberg et al.
D738,470 S 9/2015 Eaton et al.
9,126,747 B2 9/2015 Burgess et al.
9,150,163 B2 10/2015 Cronkright, II et al.
9,150,353 B2 10/2015 Jackson
D746,128 S 12/2015 Stanton
9,199,657 B2 12/2015 Martin
9,227,571 B1 1/2016 Wilkens
9,227,768 B2 1/2016 Quick et al.
D749,653 S 2/2016 Carnes
9,278,704 B2 3/2016 Cates
9,352,698 B2 5/2016 Romanelli
D767,973 S 10/2016 DeDios-Shirley et al.
D772,383 S 11/2016 Gill
D773,621 S 12/2016 Gill
D775,952 S 1/2017 Kim
9,533,814 B2 1/2017 Brooks
9,543,558 B2 1/2017 Templeman et al.
9,550,508 B1 1/2017 Parra
D782,620 S 3/2017 Becker et al.
D785,140 S 4/2017 Gross
D787,648 S 5/2017 Smith
9,750,371 B2 * 9/2017 Bungard ..... A47J 41/0055
2002/0038745 A1 4/2002 Lamming
2004/0232637 A1 11/2004 Butler
2004/0251444 A1 12/2004 Levey et al.
2006/0260327 A1 11/2006 Kanamori et al.
2006/0261088 A1 11/2006 Chin
2006/0261111 A1 11/2006 McCoy et al.
2007/0045368 A1 3/2007 Lavelle
2007/0095998 A1 5/2007 Gray
2007/0152002 A1 7/2007 Dollar
2007/0152003 A1 7/2007 Dollar
2007/0181615 A1 8/2007 Allanson et al.
2007/0187435 A1 8/2007 Quirk
2008/0178629 A1 7/2008 Meether
2009/0241584 A1 10/2009 Hayes et al.
2010/0212351 A1 8/2010 Chapin et al.
2010/0215455 A1 8/2010 Burris
2011/0062156 A1 * 3/2011 Smeaton ..... B65D 77/067 220/202
2011/0240684 A1 10/2011 McSavaney
2012/0111892 A1 5/2012 Leith, Sr. et al.
2014/0252010 A1 9/2014 Miller
2015/0048118 A1 2/2015 English et al.
2015/0375918 A1 12/2015 Holderness et al.
2016/0114347 A1 4/2016 Kosarnig
2016/0220925 A1 8/2016 Savoy et al.
2016/0340217 A1 * 11/2016 Kuennen ..... C02F 1/283
2017/0203308 A1 7/2017 Huang

FOREIGN PATENT DOCUMENTS

EP 2873626 A1 5/2015
GB 484091 A 4/1938
WO 10044074 A1 4/2010

OTHER PUBLICATIONS

MVP 7812 package—3 Burner Grill, Tailgate Transport & Ice Chest Tray [online], [retrieved Oct. 12, 2017], Retrieved from the Internet, URL: <http://partykinggrills.com/shop/mvp-grill-tailgate-transport-ice-chest-tray/>; 5 color pages, published date unknown, but for purposes of patent prosecution presumably more than a year prior to the filing date of the present application.

(56) References Cited

OTHER PUBLICATIONS

Great Day Hitch-N-Ride Cargo Carriers—HNR100TF [online], [retrieved Oct. 12, 2017], Retrieved from the Internet, URL: <http://www.autoanything.com/roof-racks/77A7418A4464928.aspx>; 3 color pages, published date unknown, but for purposes of patent prosecution presumably more than a year prior to the filing date of the present application.

Rubbermaid FG9F1900BLA ProServe Black Dolly with Retention Strap for 9F12, 9F13, 9F14, 9F15, and 9F16 Insulated Food Pan Carrier [online], [retrieved Oct. 12, 2017], Retrieved from the Internet, URL: <https://www.webstaurantstore.com/rubbermaid-9f19-proserve-black-dolly-with-retention-strap-for-9f12-9f13-9f14-9f15-and-9f16-insulated-food-pan-carrier-fgf1900bla/6909F19.html>; 4 color pages, published date unknown, but for purposes of patent prosecution presumably more than a year prior to the filing date of the present application.

Yeti Cooler Mounted In Baja Basket—Photo 08 [online], [retrieved Oct. 12, 2017], Retrieved from the Internet, URL: <http://www.fourwheeler.com/how-to/body-chassis/1503-adding-synergy-manufacturings-baja-basket-storage-solution/photo-08.html>; 6 color pages, published date unknown, but for purposes of patent prosecution presumably more than year prior to the filing date of the present application.

Vow Selling Cooler Commander (7 Pictures) [online], [retrieved Oct. 12, 2017], Retrieved from the Internet, URL: <http://www.rzrforums.net/utv-family/304697-now-selling-cooler-commander-7-pictures.html>; 7 color pages, published date unknown, but for purposes of patent prosecution presumably more than a year prior to the filing date of the present application.

Engel USA Cooler Tie-Down Strap Kit [online], [retrieved Oct. 12, 2017], Retrieved from the Internet, URL: <https://www.amazon.com/Engel-USA-Cooler-Tie-Down-Strap/dp/B0078T3MWY; 6 color pages, published date unknown, but for purposes of patent prosecution presumably more than a year prior to the filing date of the present application.

Yeti Cooler Slide Out Mounting Kit [online], [retrieved Oct. 12, 2017], Retrieved from the Internet, URL: <http://archive.constantcontact.com/fs085/1102686599059/archive/1108110340931.html>; 5 color pages, published date unknown, but for purposes of patent prosecution presumably more than a year prior to the filing date of the present application.

ARB [online], [retrieved Oct. 12, 2017], Retrieved from the Internet, URL: <https://www.streetsideauto.com/p/arb-10900010/?utm_source=googlepepla&utm_medium=adword&gclid=CPTh3omE69MCFRtYDQodyVIBUg>; 2 color pages, published date unknown, but for purposes of patent prosecution presumably more than a year prior to the filing date of the present application.

* cited by examiner

SPIGOT AND SPIGOT GUARD FOR AN INSULATING CONTAINER

CROSS REFERENCE TO RELATED APPLICATIONS

This application is a continuation-in-part of and claims priority to U.S. patent application Ser. No. 15/133,393, filed Apr. 20, 2016, and entitled, "Insulating Container," which is incorporated herein by reference in its entirety.

BACKGROUND

Various types of containers are often used to store liquid, as well as containers or other items, such as food. In some arrangements, it may be advantageous to maintain a temperature of the contents being stored in the container. Accordingly, an insulating container may be used. However, conventional insulating containers are often not very durable. For instance, they have lids that may be lost or broken, handles that may protrude from a base portion of the container, and/or a spigot that protrudes outward from the container. In these arrangements, the lid, handle, and/or spigot may be susceptible to breakage, which, in some cases, may render the container virtually useless.

BRIEF SUMMARY

This Summary is provided to introduce a selection of concepts in a simplified form that are further described below in the Detailed Description. The Summary is not intended to identify key features or essential features of the claimed subject matter, nor is it intended to be used to limit the scope of the claimed subject matter.

Insulating containers having various features are described herein. In some examples, the insulating containers may include a base and a lid. The lid may be rotatable about a hinge from a closed position or configuration to an open configuration. In some examples, the insulating container may include at least one latching device. The latching device may have a portion arranged on the lid and a portion arranged on the base and may be configured to secure the lid in the closed configuration. In some arrangements, the latching device may include an additional portion arranged on another side of the base and configured to secure the lid in the open configuration.

In some examples, the rotatable lid may be non-destructively removable from the base. Accordingly, the lid may be removed from the base, as desired, and reattached, as desired. In some arrangements, the removable lid, when removed, may be secured to the base via the additional portion of the latching device.

In some arrangements, the insulating container may include handles that are integrally formed with the base. The handles may be formed as undercuts in a sidewall of the base and may be flush with an exterior surface of the base. Additionally or alternatively, the base may include a recess in which a spigot is arranged. A spigot guard may extend from one edge of the recess, across the spigot, to an opposite edge of the recess, in order to protect the spigot while allowing use of the spigot.

In some examples, the spigot may be disassembled and reassembled to permit cleaning of the spigot and various components. For instance, the spigot may include a spigot body, a threaded valve rod extending through the spigot body and connecting to a button configured to dispense fluid from the insulating container. The spigot may further include a spigot nut connected to a threaded portion of the spigot body and arranged on an interior of the insulating container to maintain a position of the spigot.

In some arrangements, the spigot guard may include two side spigot guards, one arranged on each side of the spigot. The side spigot guards may be integrally formed with the base of the insulating container. In some examples, the spigot guard may also include a spigot cross guard that may be formed separately from the base and connected to the base.

These and various other features will be described more fully herein.

BRIEF DESCRIPTION OF THE DRAWINGS

The present invention is illustrated by way of example and not limited in the accompanying figures in which like reference numerals indicate similar elements and in which.

Further, it is to be understood that the drawings may represent the scale of different components of one single embodiment; however, the disclosed embodiments are not limited to that particular scale.

DETAILED DESCRIPTION

Aspects of this disclosure relate to an insulating container configured to store a volume of liquid, or other contents. In some examples, the insulating container may include a locking lid that may be hinged to allow the lid to rotate from a closed position to an open position that is approximately 270° from the closed position, and/or be non-destructively removable (e.g., able to be removed and replaced) from a base portion of the insulating container. Additionally or alternatively, the insulating container may include a gasket having a V-shaped portion that aids in venting the insulating container. Additionally or alternatively, the insulating container may have handles that are integrally formed in the base portion of the insulating container. In still other examples, the insulating container may include a guard or other device configured to protect a spigot or spout arranged on the insulating container, while permitting use of the spigot. These and various other features and aspects of the insulating container will be described more fully herein.

In the following description of the various embodiments, reference is made to the accompanying drawings, which form a part hereof, and in which is shown by way of illustration various embodiments in which aspects of the disclosure may be practiced. It is to be understood that other embodiments may be utilized and structural and functional modifications may be made without departing from the scope and spirit of the present disclosure.

Figure 1B:
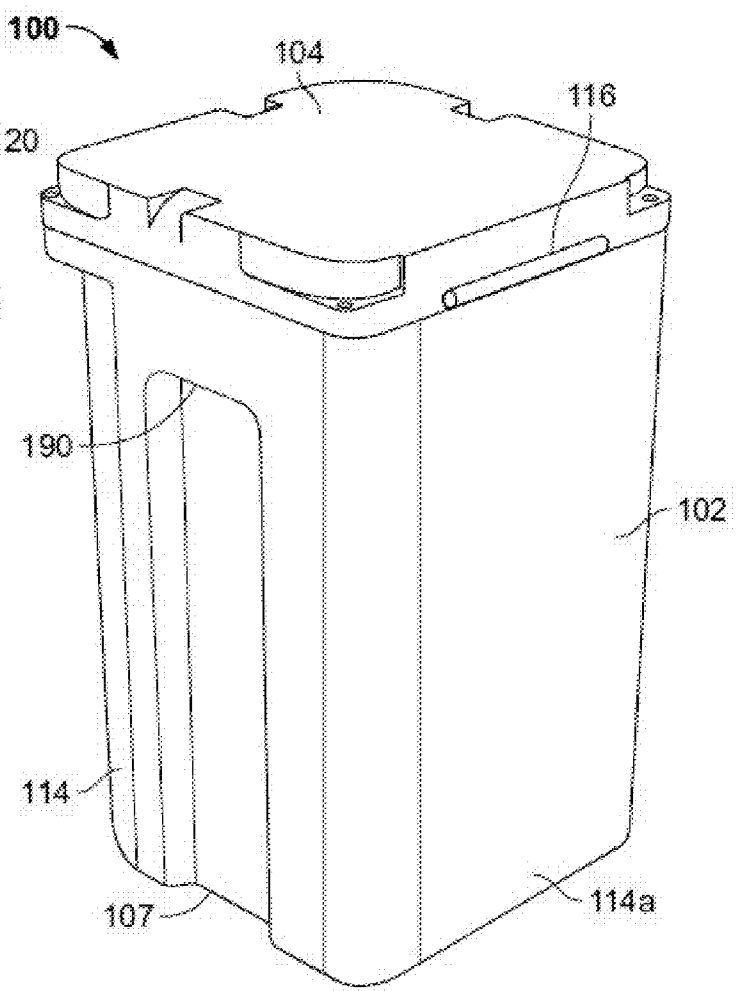
FIGS. 1A and 1B are front and rear perspective views, respectively, of an insulating container according to one or more aspects described herein.
Figure 1A:
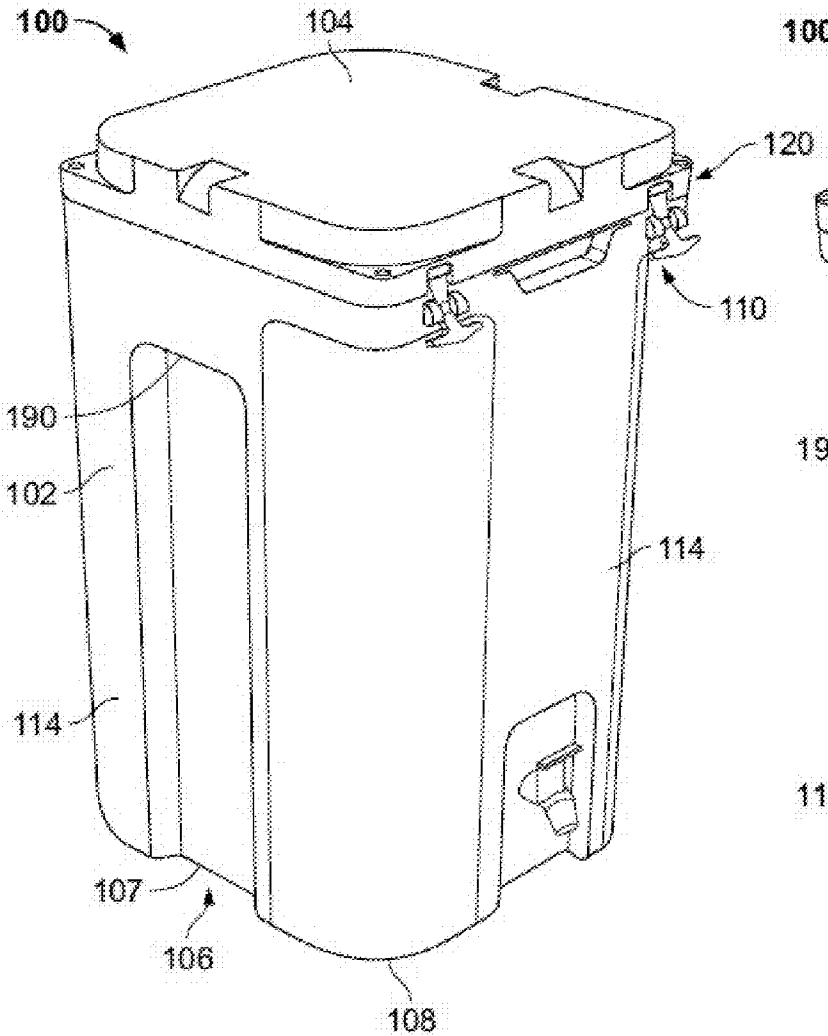

FIGS. 1A and 1B depict perspective views of an insulting container 100. In one example, the insulting container 100 may comprise a base portion 102 and a lid 104 that, in some examples, may be non-destructively, removably coupled thereto. The base portion 102 may be an insulated structure forming a void for containing a liquid, as will be discussed more fully herein. In some examples, the base portion 102 may be cuboidal or substantially cuboidal in shape. In other examples, the base portion 102 may be prismoidal or substantially prismoidal (e.g., a pentagonal prism, hexagonal prism, heptagonal prism, or the like) in shape. In still other examples, the base portion 102 may be substantially cylindrical in shape or may have a substantially trapezoidal cross section. Various other shapes may be used without departing from the invention.

The base portion 102 may include a first end 106, having a bottom surface 108. The bottom surface 108 may be configured to support the insulating container on a surface, such as a table, the ground, a vehicle bed, or the like. In some examples, the bottom surface may have a shape that is configured to correspond to a mounting structure in order to facilitate mounting and/or securing the insulating container 100 to, for example, a bed of a truck. For instance, cut-outs 107 shown in FIGS. 1A and 1B may be configured to align with a mounting structure arranged in the vehicle bed and may aid in securing the insulating container 100 to the vehicle bed.

The base portion 102 further includes a second end 110 defining an opening 112 (shown in FIG. 2) that may be used for filling the insulating container. The opening 112 may be covered by lid 104, when the insulting container is in use (e.g., when the insulating container is in a closed configuration). The base portion 102 may further include a plurality of side portions 114 connected to the bottom surface that define a void for receiving liquid in the insulating container 102. The side portions 114 may be arranged such that they extend generally perpendicularly from the bottom surface.

In some arrangements, one or more handles 190 may be arranged in one or more side portions 114 (or other region of the base portion 102). The handles may be integrally molded with the base portion 102 and may generally be an undercut formed in the side portion 114 of the base 102. In some examples, such as shown in FIGS. 1A and 1B, the undercut forming the handle may include a recess extending along substantially all or a majority of the side portion 114. This may provide ease of manufacturing the base 102 with the integrally molded handles 190. In some examples, the handles 190 may be flush with an exterior surface of the base 102 in order to reduce the risk of breakage. These and various other handle features and arrangements will be discussed more fully below.

As discussed above, the insulating container 100 may be configured to contain, store, carry, etc., a volume of liquid. In some examples, the insulting container 100 may be configured to store between five (5) and ten (10) gallons (between 18.93 and 37.85 L) of a liquid. In some examples, the insulating container may be configured to store approximately five (5) gallons (approximately 18.93 L) of a liquid.

In other examples, the insulating container may be configured to store at least four (4) gallons (approximately 15.14 L) of liquid, at least approximately three (3) gallons (approximately 11.36 L) of liquid, at least approximately two (2) gallons (approximately 7.57 L) of liquid, or at least approximately one (1) gallon (approximately 3.79 L) of liquid, among others. Additionally or alternatively, the insulating container 100 may be configured to store materials in a solid or a gaseous state, or combinations thereof, without departing from the scope of the disclosure described herein.

In at least some examples, the insulating container 100 (and various other containers described herein) may be sized to accommodate the volumes of liquid described above. For instance, the insulating container 100 may be between 10 and 24 inches tall, between 10 and 24 inches wide, and between 10 and 20 inches deep.

The insulating container 100 may include a lid 104. In some arrangements, the lid 104 may connect to the base 102 in a closed configuration using a press fit. Additionally or alternatively, other securing systems or devices may be used to secure the lid 104 to the base, as will be discussed more fully herein.

In some examples, the lid 104 may be hinged such that it is connected to (either removably or permanently) the base 102 at a hinge 116 and may be rotated about the hinge 116. The hinge may be one of various types of hinges, including a continuous piano hinge, double hinge, ball joint hinge, living hinge, and the like. These and various other hinge arrangements may be discussed more fully herein. The hinge 116 may permit the lid 104 to be opened and rotated away from the base portion 102, to allow access to the void defined by the base portion 102 (e.g., via opening 112). That is, the hinge may facilitate rotation of the lid 104 from a closed configuration of the insulating container (e.g., when the lid is in place covering the void formed by the base) to an open configuration (e.g., when the lid is not covering the void formed by the base), and vice versa.

Figure 2:
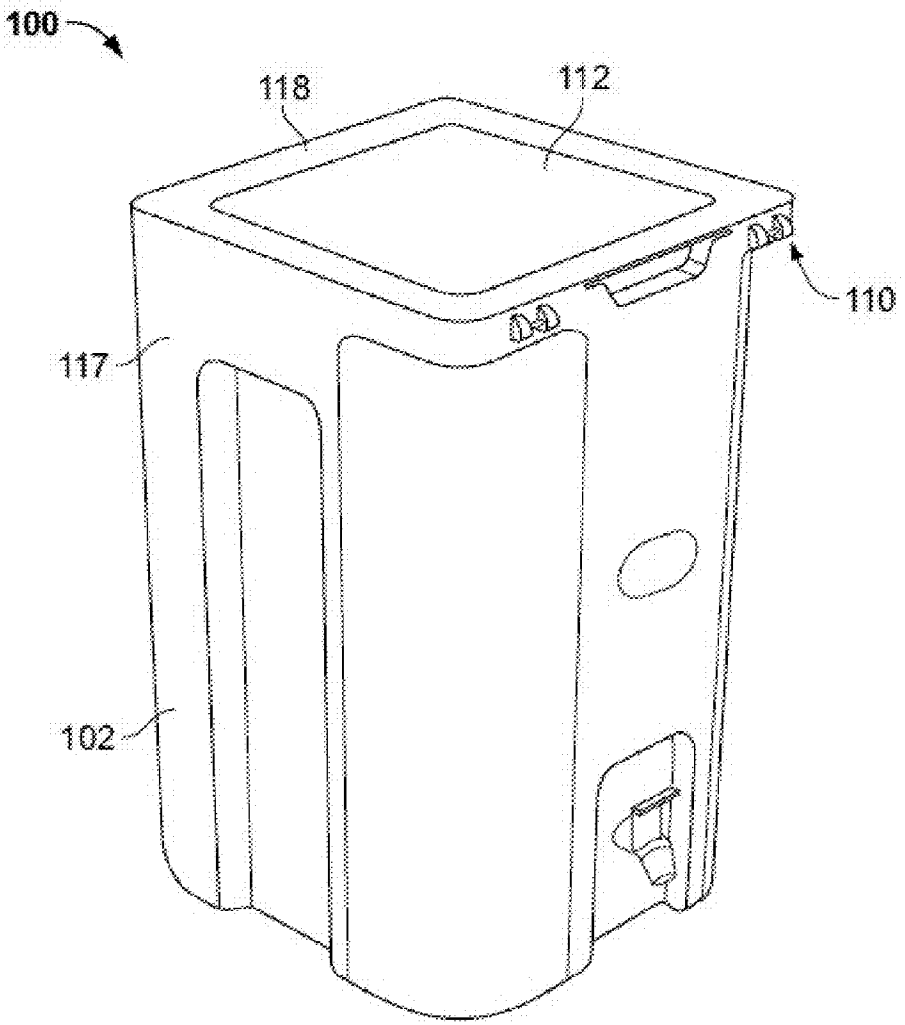
FIG. 2 is a perspective view of the insulating container of FIGS. 1A and 1B with a lid portion removed according to one or more aspects described herein.

In the arrangements described herein, base 102 and lid 104 may include an exterior surface or outer shell 117 surrounding and enclosing an insulating portion 118, as shown in FIG. 2. The shell 117 is typically formed from various materials, such as one or more metals, alloys, polymers, ceramics, or fiber-reinforced materials. In some examples, the shell 117 may be formed of a plastic material, such as polyethylene, that is molded to form both the base 102 and lid 104 portions. In some examples, the insulating portion 118 is formed of an insulating material that exhibits low thermal conductivity. For instance, the insulating portion 118 may be formed of (or filled with) a polymer foam, such as polyurethane foam. Additional or other insulating materials may be used without departing from the invention. In some arrangements, the base 102 and lid 104 portions are formed using a roto-molded process as would be understood by one of ordinary skill in the art (not shown). However, various other types of molding or other manufacturing processes (e.g., stamping, casting, forging, and the like) may be used to form the insulating container without departing from the invention.

In some examples, the lid 104 may be configured to remain connected to the base portion 102 in both an open configuration and a closed configuration. For instance, the lid 104 may be secured or locked in a closed position using latching devices 120. The latching devices 120 may be various types of latches, including a t-latch having a latch portion and a keeper portion, as well as various other types of latches.

For instance, one example latching device 120 that may be used with the insulating container 100 is described with reference to FIGS. 3 and 4. The latching device 120 shown and described is merely one example latch that may be used and various other types of latches may be used without departing from the invention.

Figure 3:
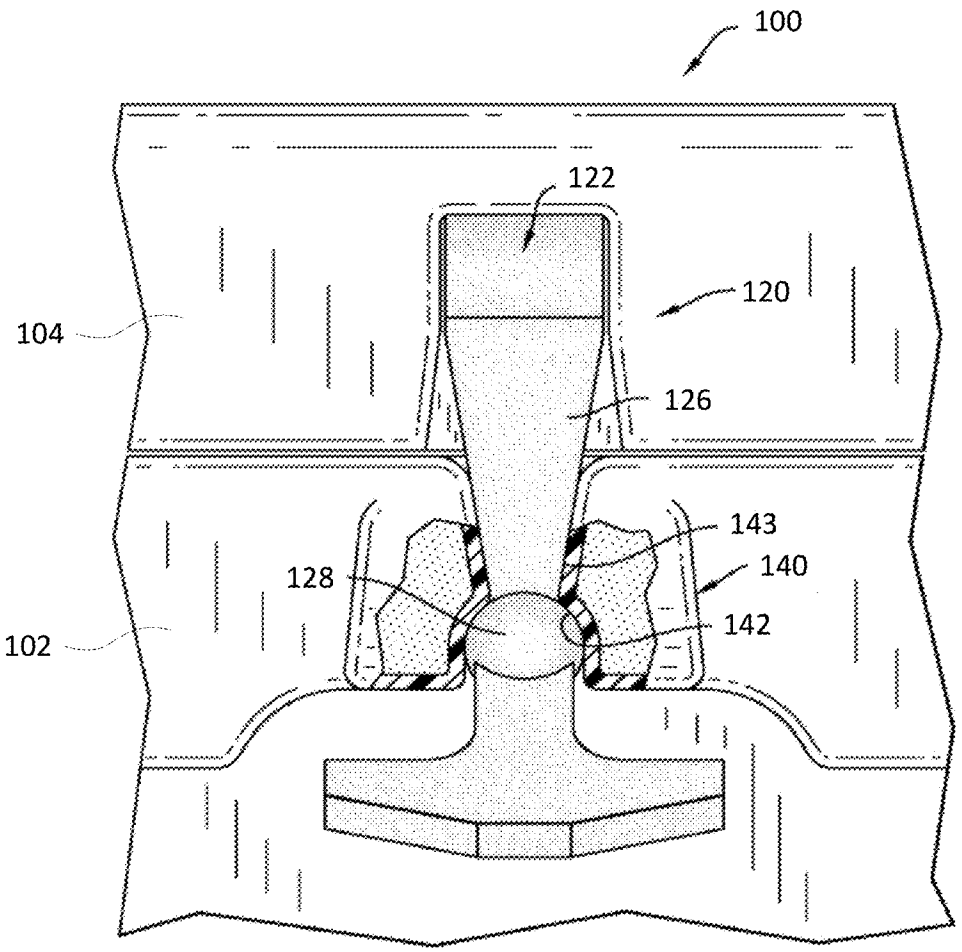
FIG. 3 is a plan view of a latching device or mechanism with a cut-away of an engaging portion according to one or more aspects described herein.

FIG. 3 is a plan view of an example latching device 120 including a cut-away of an engaging portion. The latching device 120 includes a latch portion 122 and a keeper portion 140. In the arrangements shown, the keeper 140 includes 2 portions that extend along either side of a stem 126 of the latch 122. In the example shown in FIG. 3, the latch 122 is connected to lid 104, while the keeper 140 is connected to the base 102. However, in some examples, the latch 122 may be connected to the base 102 while the keeper 140 is connected to the lid 104. Accordingly, the latch 122 and keeper 140 are interchangeably positionable on either portion of the insulating container 100.

Figure 4:
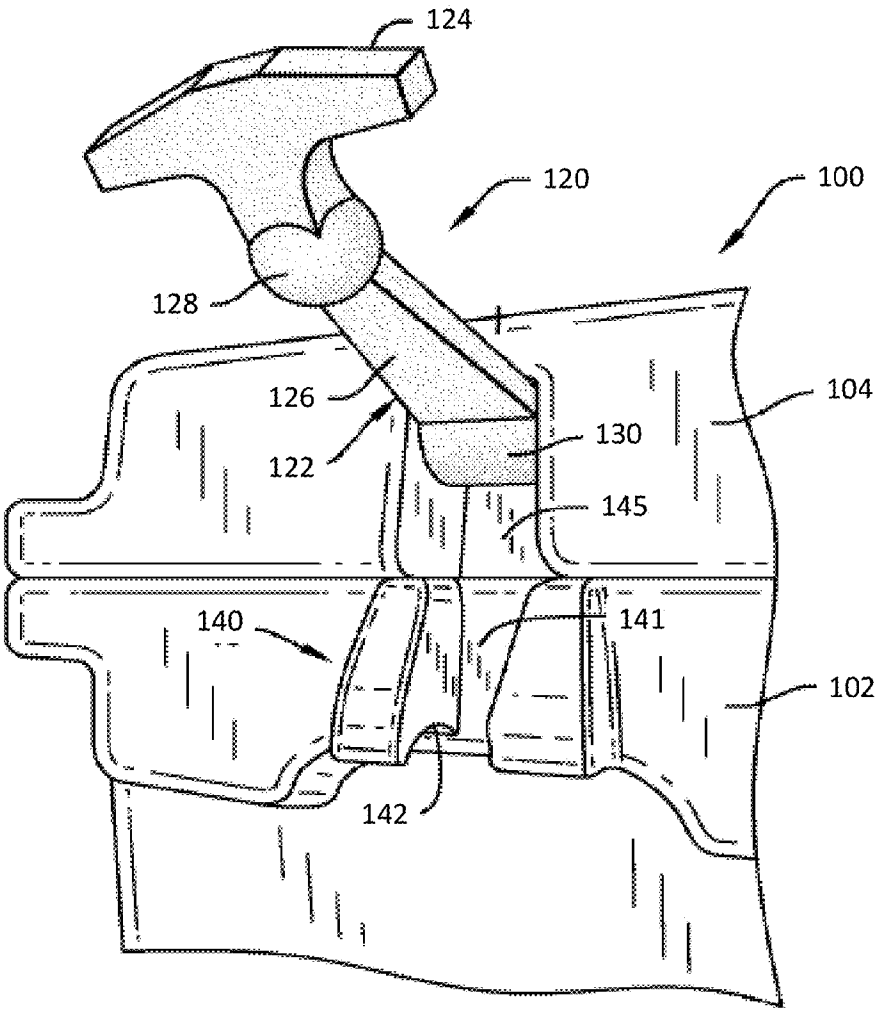
FIG. 4 is a perspective view of a latching device or mechanism according to one or more aspects described herein.

With reference FIGS. 3 and 4, the latch 122 is configured to be releasably engageable with the latch keeper 140 such that when the latch 122 is in an engaged relationship with the keeper 140, the opposing lid portion 104 and base portion 102 are maintained in the closed, secured, and/or sealed position. In some arrangements, the latch 122 includes a latch base 130, a stem or body portion 126 extending from the latch base 130, an engaging portion 128 extending from the body portion 126 and a grasping portion 124 extending from the engaging portion 128. In other words, the latch base 130 of the latch 122 is arranged on one end of the latch 122, while the grasping portion 124 is arranged on the opposite distal end of the latch 122. The engaging portion 128 is configured for locking, mating relationship with a recessed pocket or notched area 142 of the latch keeper 140 as will be discussed in more detail below.

The latching device 120 further includes a latch slot 145. The latch slot 145 may be integrally formed into the surface of the lid 104. The latch slot 145 is configured for receiving the latch 122. For instance, at least a portion of the latch base 130 of the latch 122 is received within the latch slot 145 when the latch 122 is engaged with the latch keeper 140.

According to one aspect of the invention, the latch 122 is made of a flexible, stretchable, resilient, one-piece molded material that is typically pivotally attached to the lid portion 104 of the container 100 and received within a recessed, elongated latch slot 145 which is typically integrally molded to the container 100. The latch 122 may be molded in a single-piece construction from rubbery materials as would be understood by those of ordinary skill in the art. The latch 122 may be formed of a material that is formed or made from a plastics material or another suitable material which can be formed or molded into a shape and thus retain the shape to which it has been formed. The latch 122 may be made of sufficient size, thickness and materials of construction to withstand repeated cycles of stress as the latch is engage/disengaged with the latch keeper 140 over time. In any case, the material of construction is one that is stretchable and/or resilient (e.g. EPDM or Neoprene rubber) such that when the latch 122 is extended or otherwise stretched to an elongated position, either to engage or disengage the latch keeper 140, it rebounds or otherwise returns to its originally un-stretched state or partially stretched state to maintain sufficient tension to maintain the closed position, with little or no deformation. In other words, the latch 120 is able to recoil or spring back or otherwise return into its original or near-original shape after bending, stretching, or being compressed and when in an un-stretched position.

In some arrangements, the latch 122 is configured such that the grasping portion 124 extends from the body portion 126 at an angle that departs from the plane of the latch 122. The angle between the grasping portion 124 and the body portion 126 may aid in or facilitate grasping the latch 122 by a user. At this angle, the user is easily able to slip his or her fingers between the grasping portion 124 and the side of the base portion 102 of the insulating container 100 for disengaging the latch 122 from the keeper 140. Further, because the latch 122 is made from a resilient material, even though the latch extends from the body of the container, it is not easily dislodged or broken.

The grasping portion 124 is typically formed into a shape that is easily grasped by a user, and as shown in the figures, the grasping portion 124 is formed into a t-shape to facilitate grasping by a user. Without intending to be limited thereby, other shapes contemplated for the grasping portion 124 include y-shaped and tab-shaped (not shown), or a small flap of material extending from the engaging portion and capable of being grasped for manipulation of the latch.

Turning to another feature of the latching mechanism 120, the latch keeper 140 is integrally molded within the base portion 102. The latch keeper 140 includes an elongated keeper slot 141 and a recessed pocket 142 formed in the keeper slot 141. The recessed pocket 142 is typically configured for receiving the engaging portion 128 of the latch 122, and the keeper slot 141 is typically configured for receiving the body portion 126 of the latch 122.

In some examples, the body portion 126 of the latch 122 is formed into a cross-sectional inverted triangular shape 143 and the elongated keeper slot 141 of the latch keeper 140 is also formed/molded into a complimentary triangularly shape receiving portion to match the body portion 126 of the latch 122. In an embodiment, when the latch 122 is seated/received within the elongated keeper slot 141, the latch 122 forms a friction fit with the elongated keeper slot 141. Similarly, the body portion 126 and elongated keeper slot 141 could be formed into complimentary three dimensional pyramidal, square or rectangular shapes (not shown).

In some examples, engaging portion 128 of the latch 122 may be formed into a ball-shape and the recessed pocket 142 of the latch keeper 140 is configured as a complimentary shaped socket 142 to receive the ball-shaped engaging portion 128. Thus, when the engaging portion 128 is seated within the recessed pocket 142, the parts are mechanically coupled and there is an increased contact area between the surfaces of parts, which further ensures maintenance of the closed and/or sealed position. It is also contemplated that the engaging portion is capable of taking any shape that is easily received by a reciprocatingly shaped recessed pocket formed in the latch keeper. For instance, the engaging portion could be formed into any geometric shape, such as a triangle, square, and the like. Thus, the recessed pocket of the latch keeper 140 would have a corresponding configuration capable of receiving the shaped engaging portion. In other words, the engaging portion of the latch and the recessed pocket of the latch keeper are shaped so as to be matingly coupled together. Thus, the recessed pocket has a shape configured to receive the engaging portion while providing a surface-to-surface contact area sufficient to maintain the closure.

More specifically, in some arrangements, the latch includes is an integrated ball and socket latching system for an insulating container 100. The latch keeper 140 is designed to be part of the mold of the insulating container 100 and an exact fit for the ball-shaped engaging portion 128 is molded on a stretchable rubber latch 122 having a t-shaped end. This combination provides a strong and very secure lid latching system.

FIG. 3 illustrates the latching device 120 in a closed position, while FIG. 4 illustrates the latching device 120 in an open position. When in a closed position, the latching device 120 is positioned such that the lid 104 abuts the base 102 of the insulating container 100, thus closing, securing, and/or sealing the container. To disengage the latching device 120, the grasping portion 124 is pulled/stretched generally downward, toward the base 102 of the container 100. In other words, the body portion 126 of the latch 122 stretches so that the engaging portion 128 disengages from the latch keeper 140. Once the engaging portion clears the latch keeper 140, the latch 122 is swung upward, away from the container, and in an arc.

Similarly, to close the container 100, the latch 122 is moved in a downward arc, toward the container 100. When the movement of the latch 122 reaches the latch keeper 140, the latch 122 is once again extended/stretched downward, toward the base 102 and the body portion 126 of the latch 122 is seated/positioned within the keeper slot 141, preferably in a friction fit as described above. Further, when in the seated position, the body portion 126 of the latch 122 may be mostly recessed within the latch slot 145 and the keeper slot 141, and, in some examples, does not extend or protrude beyond the surface thereof. When the stretching force is removed from the latch 122, the latch is free to attempt to return to its former state, thus allowing the engaging portion 128 of the latch 122 to become seated and received within the recessed pocket 142 of the latch keeper 140, thus closing the latching mechanism. As will be understood by one of ordinary skill in the art, the latch 122 is made of materials and sized such that when in the closed/seated position, enough force remains to maintain the closed position of the container. In other words, in the closed position, a certain amount of tension is maintained on the latch 122 as it is not completely returned to its unstretched position/state. In the closed position, the engaging portion 128 of the latch 122 is received within the recessed pocket 142 of the keeper slot 140. In some example arrangements, the engaging portion 128 is sized and shaped so as to provide maximum contact with the recessed pocket 142, thus ensuring an easily maintainable closure.

With further reference to FIGS. 1A, 1B, and 2, to open the lid 104 (e.g., to allow access to an interior void formed by the base 102), the hinged lid 104 may be rotated away from the base portion 102 and may rest along a rear side 114 of the base portion 102 (e.g., the lid may rotate 270° from a closed configuration (e.g., the position shown in FIGS. 1A and 1B) to an open configuration). In some arrangements the fully open position or configuration may include at least a portion of a top, exterior surface of the lid 104 being in contact with a rear (or other) side portion 114 of the base portion 102 of the insulating container 100.

Figure 5B:
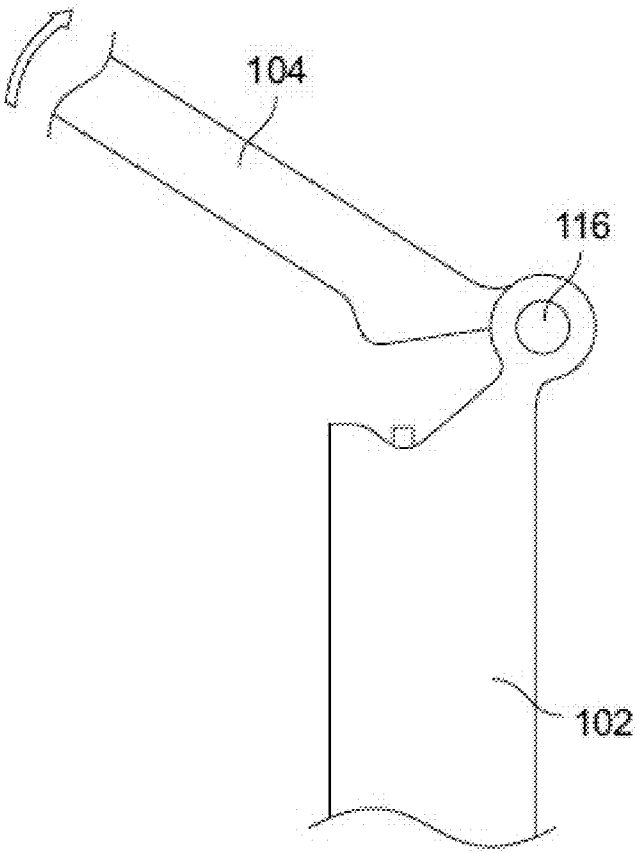
FIGS. 5A-5D illustrate one hinge arrangement in which a lid may be rotated from a closed configuration to an open configuration according to one or more aspects described herein.
Figure 5A:
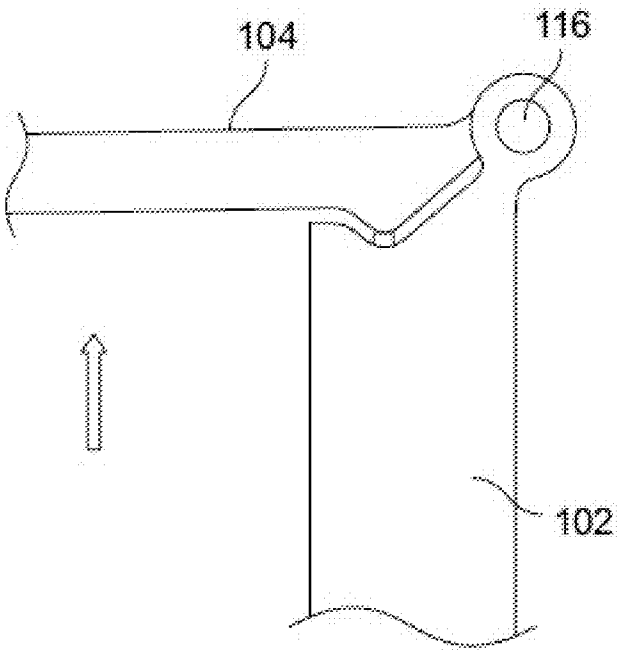
Figure 5D:
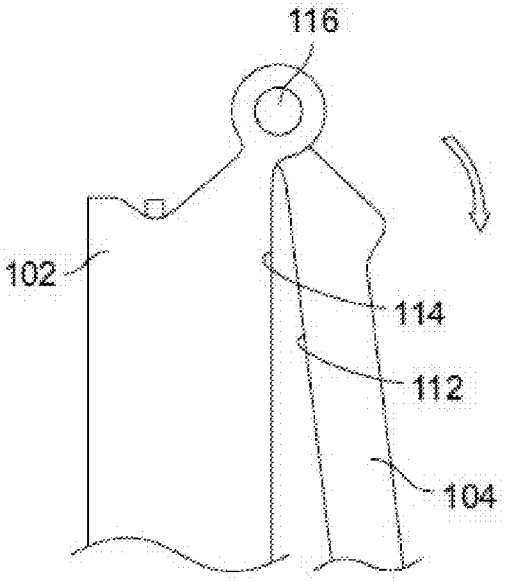

For example, FIGS. 5A-5D illustrate one example rotation of the lid 104 with respect to the base portion 102 from a closed position or configuration (FIG. 5A) to a fully open position or configuration (FIG. 5D). For instance, as shown in FIG. 5A, the lid 104 is in a substantially closed position. That is, the lid 104 is substantially perpendicular to the base 102 and is covering the opening (not shown in FIG. 5A). In order to open the lid 104, and thereby access the void defined by the base 102 of the insulating container 100, the lid 104 may be lifted upward, in the direction of the arrow shown in FIG. 5A.

Figure 5C:
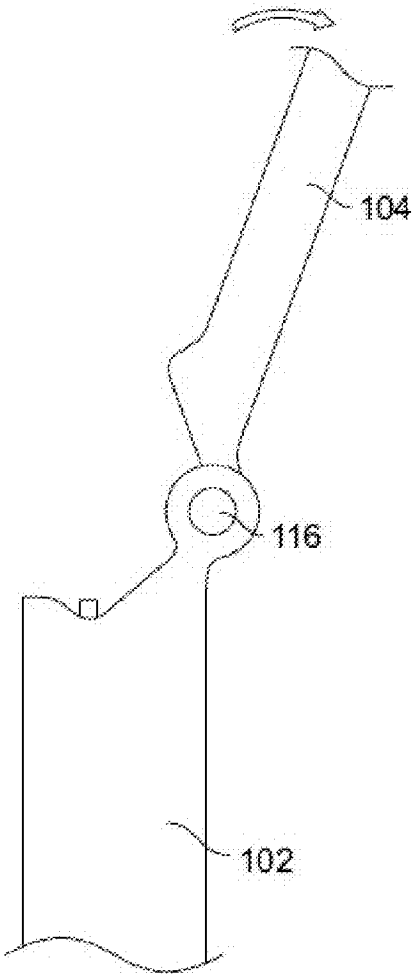

The lid 104 may then rotate about hinge 116, as shown in FIG. 5B. That is, the lid 104 is now shown at an angle relative to the former perpendicular position (shown in FIG. 5A) which indicates that the lid 104 is being opened. The lid 104 may continue to rotate about hinge 116, as shown in FIGS. 5C and 5D, until the lid 104 is in the fully open position shown in FIG. 5D. When in the fully open position, at least a portion of a top, exterior surface 118 of the lid 104, may be in contact with a rear side 114 of the insulating container 100. In some examples, the fully open position or configuration may be 270° from the closed position.

Figure 7:
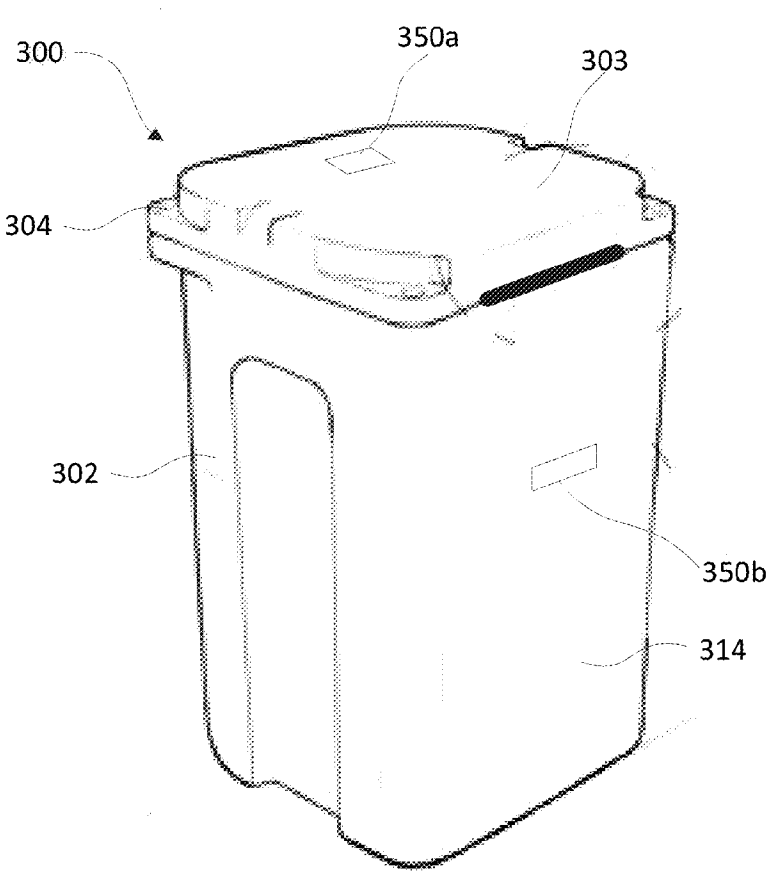
FIG. 7 is a rear perspective view of an insulating container having another example securing portion for securing a lid in an open configuration according to one or more aspects described herein.
Figure 6:
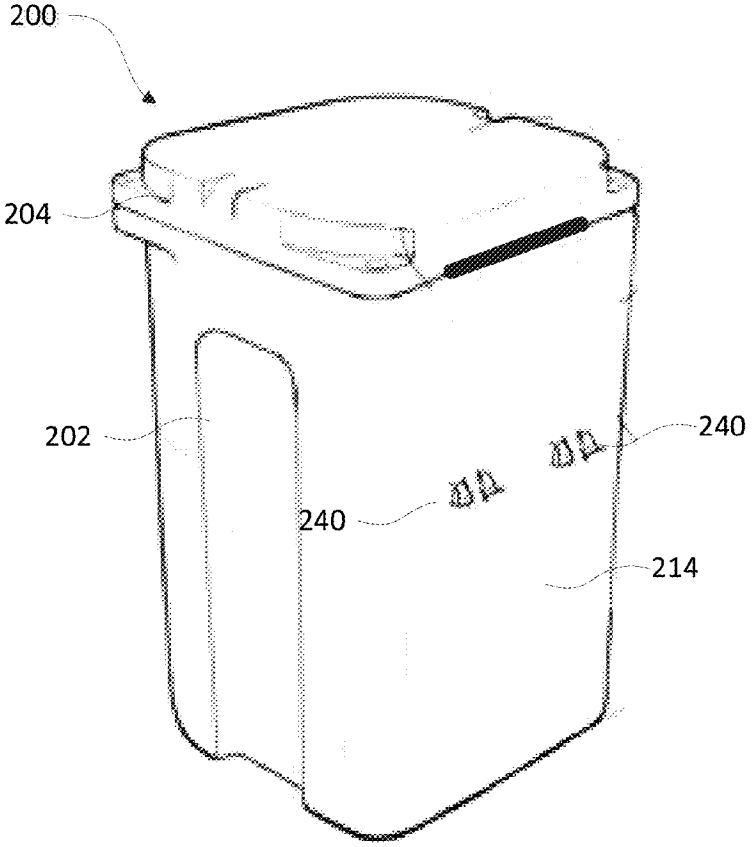
FIG. 6 is a rear perspective view of an insulating container having one example securing portion for securing a lid in an open configuration according to one or more aspects described herein.

In some examples, when in a fully open position, the lid 104 may be held in place in the fully open position by one or more locking or latching mechanisms or devices. FIGS. 6 and 7 illustrate some example latching systems that may be used to hold the lid 104 in the fully open position. The insulating containers 200 and 300, shown in FIGS. 6 and 7, respectively, may be substantially similar to insulating container 100 (or various other insulating container described herein) and may include some or all of the features described with respect to insulating container 100, or any other insulating container described herein.

FIG. 6 illustrates one arrangement in which the insulating container 200 includes latching devices similar to those discussed with respect to FIGS. 3 and 4. That is, the latching devices include keepers on the front of the container (e.g., similar to container 100 shown in FIG. 1A including latching devices to secure the lid 104 in the closed position). In addition, a second set of keepers 240 may be arranged on a rear or back side 214 (e.g., the side receiving the lid 204 when open) of the base 202, as shown in FIG. 6. Accordingly, when the lid 204 is in the fully closed position, the engaging portion of a latch (not shown) will be received in and engaged with keepers formed on the front of the insulating container (as shown in FIGS. 1A and 1B) and when the lid 204 is in a fully open position, the engaging portion of the latch (not shown) may be received in the keepers 240 formed on the rear side 214 of the base 202 to maintain the position of the lid 204 (e.g., to secure the lid 204 to the rear side 214 of the base 202).

Similar to the arrangements discussed above, the keepers 240 may be molded into the base 202. A similar process to that described above may be used to engage/disengage the latch with the keepers 240 (e.g., when engaged with the keepers, grasping portion is pulled downward and rotated up, away from container, when disengaged, grasping portion is rotated downward, toward container and is stretched downward to engage the keeper).

FIG. 7 illustrates another example arrangement in which an insulating container 300 having a lid 304 may be secured in both an open configuration and a closed configuration. Similar to other arrangements discussed herein, the insulating container 300 includes a lid 304 and a base 302. The lid 304 and base 302 may have one of various types of securing arrangements to secure the lid 304 to the base 302 when the lid 304 is in the closed configuration. Additionally or alternatively, the insulating container 300 may include an open configuration latching system including a plurality of magnets 350*a*, 350*b*. A first magnet 350*a* may be arranged on a top, exterior surface 303 of the lid 304. A second magnet 350*b* may be arranged on a rear side 314 of the base 302 in a position corresponding to the position of the first magnet 350*a* when the lid 304 is in a fully open position. Accordingly, when the lid 304 is in the fully open position (e.g., rotated approximately 270° from the closed position), the first magnet 350*a* and second magnet 350*b* may be in proximity to each other and may engage via a magnetic force (i.e., may be magnetically attracted to each other to secure the lid 304 in the open configuration). The magnetic force may be strong enough to secure the lid 304 in the fully open position relative to the base 302. However, a force applied to the lid 304 (e.g., outward and/or upward, away from the base 302) may be sufficient to overcome the magnetic force and the lid 304 may be rotated to the closed position, as desired. Although the arrangement of FIG. 7 includes a first magnet 350*a* arranged on the lid 304, in some arrangements, substantially all of the exterior surface 303 of the lid 304 may be magnetic. Accordingly, in such arrangements, the placement or position of magnet 350*b* may vary because a greater portion of the surface may be available to engage with magnet 350*b*. In some examples, magnets 350*a*, 350*b* may also be used to display a logo or name of a company or manufacturer of the insulating container (e.g., a magnetic plate may be used that may display the logo or name).

The arrangements of FIGS. 6 and 7 are merely some example securing arrangements. Various other types of arrangements may be used to secure a lid in an open configuration without departing from the invention. For instance, a protrusion (e.g., male portion) may be arranged on an exterior surface of the lid and may be received in a corresponding recess (e.g., female portion) formed on the rear side of the base. When in an open configuration, the protrusion may be received in the recess and the lid may be secured via a snap fit. To return the lid to the closed configuration, the lid may be pulled away from the base to overcome the snap fit. In some examples, the protrusion may be formed on the base while the corresponding recess may be formed in the lid.

The arrangements described herein in which a lid of the insulating container may be secured in both an open configuration and a closed configuration may allow the insulating container to be used in a variety of manners without concern for the lid falling off, being lost, etc. For instance, the insulating container may be secured in the bed of a vehicle, such as a pickup truck. When driving, the lid may be secured in either the open configuration or the closed configuration to ensure that the lid is not lost due to wind, driving conditions, etc.

Figure 8:
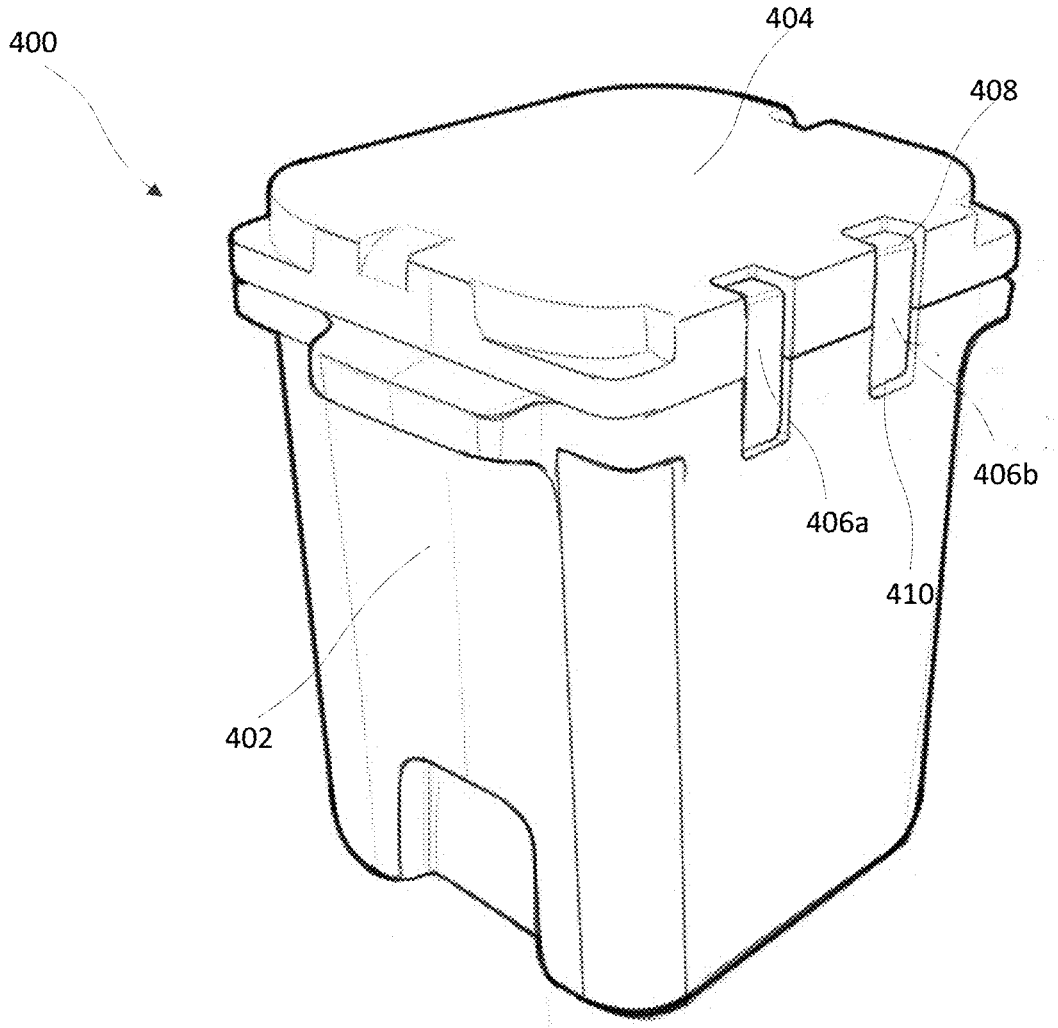
FIG. 8 illustrates one example arrangement of an insulating container having a rotatable lid according to one or more aspects described herein.
Figure 9C:
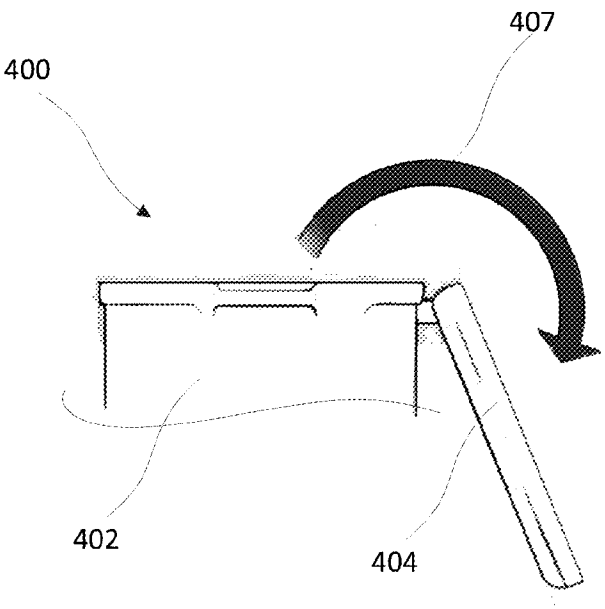
FIGS. 9A-9C illustrates rotation of a lid from a closed configuration to an open configuration according to one or more aspects described herein.
Figure 9B:
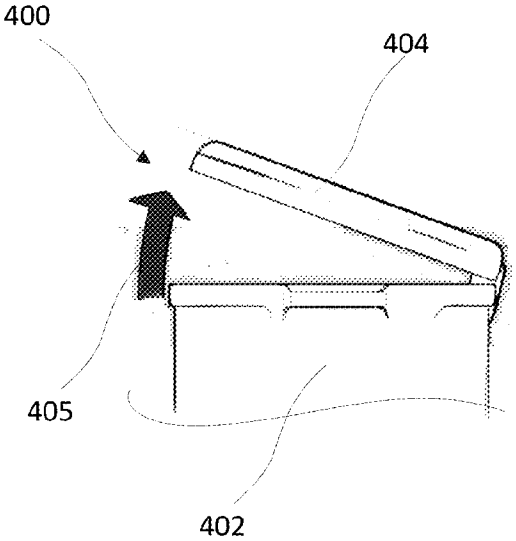
Figure 9A:
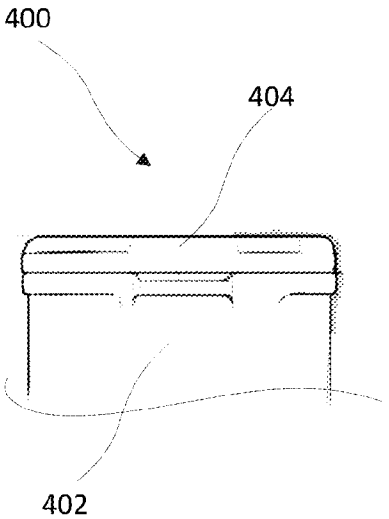

FIG. 8 illustrates another example arrangement of an insulating container 400 having a rotatable lid. As shown in FIG. 8, the insulating container 400 may include a double hinge arrangement. That is, each hinge 406*a*, 406*b* may have two pivot points to enable opening and closing of the lid 404 with respect to the base 402. For instance the lid 404 may pivot with respect to point 408 (shown on hinge 406*b* but also on hinge 406*a*), as well as point 410 (shown on hinge 406*b* but also on hinge 406*a*). FIGS. 9A-9C illustrate rotation of the lid 404 from the closed configuration to the open configuration.

For instance, FIG. 9A shows the lid 404 in a closed configuration with respect to the base 402. FIG. 9B illustrates the lid 904 as partially open with respect to the base 402. The lid 404 is being rotated in direction of arrow 405 from the closed configuration to an open configuration. FIG. 9C illustrates the lid 404 in a fully open position with respect to the base 402. The lid 404 has been further rotated in the direction of arrow 407 to open the lid 404. In some examples, the lid 404 may rotate from a closed configuration (e.g., shown in FIG. 9A) through an arc of between 90° and 270° to the open position. In some arrangements the hinge 406*a*, 406*b* may be configured to aid in maintaining the lid 404 in the open position with respect to the base 402.

Figure 10B:
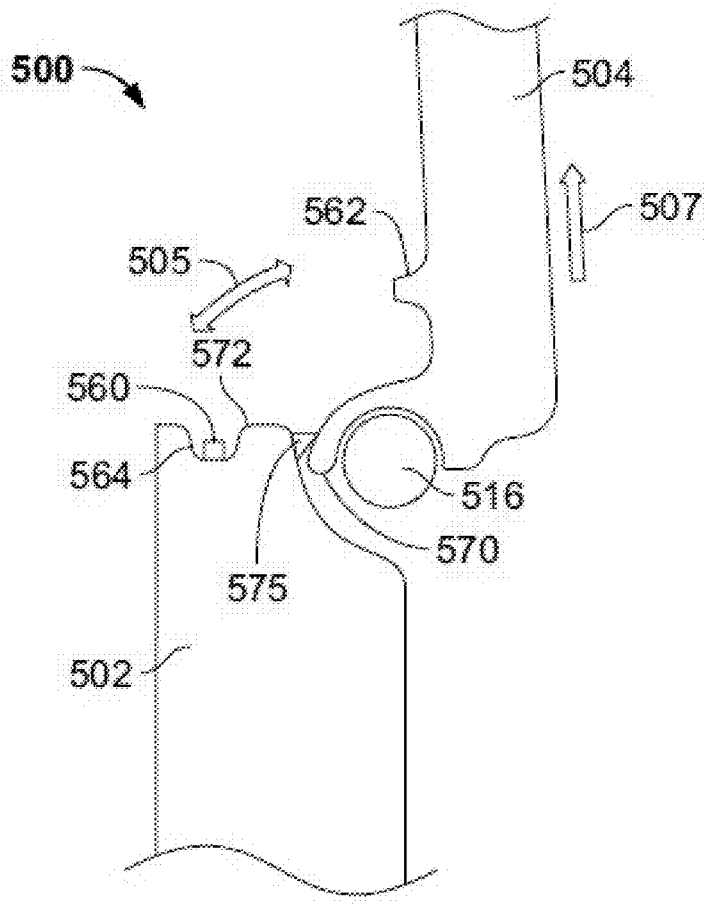
FIGS. 10A-10B illustrate one example hinged lid arrangement in which a lid may be removably connected to a base of an insulating container according to one or more aspects described herein.
Figure 10A:
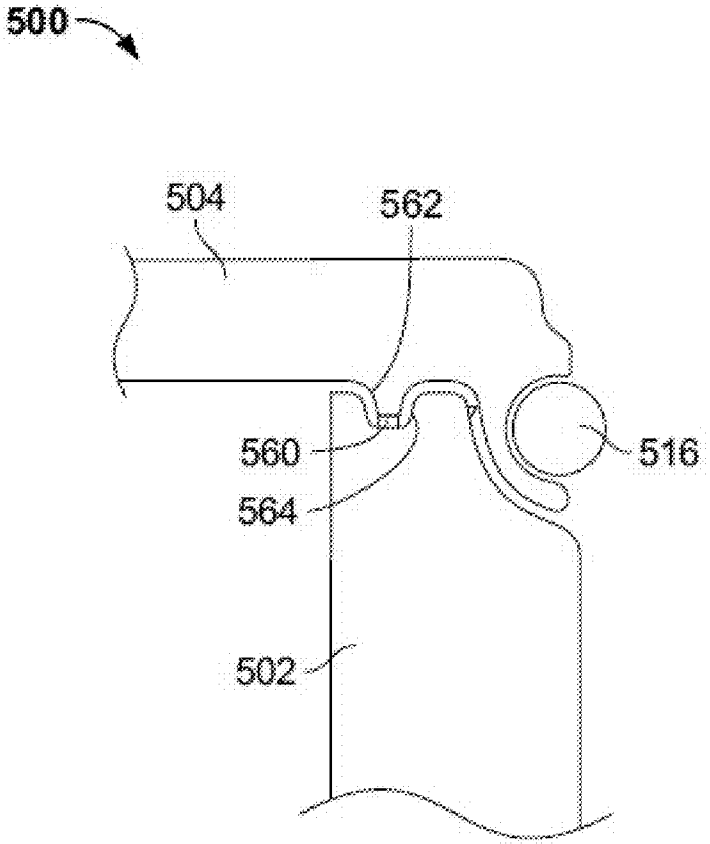

Although various arrangements discussed herein include a lid that is rotatable from a closed configuration to an open configuration and may be secured in either configuration, in some examples, the lid may be non-destructively removable from the insulating container. FIGS. 10A and 10B illustrate one example hinged lid arrangement in which the lid may be removably connected to the base of the insulating container.

FIG. 10A illustrates a portion of an insulating container 500. The insulating container 500 may be substantially similar to various other insulating containers (e.g., 100, 200, 300, 400, etc.) described herein and may include one or more features described with respect to one or more other insulating containers. The removable lid 504 is shown substantially perpendicular to the base 502 in the closed configuration of FIG. 10A. Accordingly, to open the lid 504 (and subsequently remove it from the base 502), the lid 504 may be rotated in the direction of arrow 505 in FIG. 10B.

In some arrangements, the lid 504 may be rotated around hinge 516 until first securing portion 570 (e.g., an end point of securing portion 570) is clear of second securing portion 572 (e.g., end point of second securing portion 572). At that point, the lid 504 may be lifted upward, in the direction of arrow 507, to completely detach or remove the lid 504 from the base 502. To replace the lid 504, the lid 504 may be lowered toward base 502 until first securing portion 570 is aligned with and/or in contact with second securing portion 572. Once the first and second securing portions are aligned and/or in contact, the lid 504 may be rotated downward, as indicated by arrow 505, toward the base 502.

In some arrangements, lid 504 that is non-destructively removable from the base 502 of the insulating container may include one or more latching or securing arrangements, as discussed above. For instance, although the lid 504 may be removable from the base 502, a user may desire to secure the lid 504 to the base 502 in an open configuration. Accordingly, lid 504 may include latches or a magnet (as discussed above with respect to lids 504, 504 in FIGS. 6, 7, respectively) to secure the lid 504 to a panel of the base 502 (similar to the arrangements discussed above with respect to FIGS. 6 and 7).

Optionally, in some examples, one or both of first securing portion 570 and second securing portion 572 may include a protrusion or stop 575. The protrusion may be configured to prevent the lid 504 from rotating beyond the stopping point and inadvertently become detached from the base 502. Accordingly, in arrangements having a stop, the lid 504 may be rotated to a point at which the stop 575 is engaged and, if a user desires to remove the lid 504, the user may apply an additional force to overcome the stop and subsequently remove the lid 504 from the base 502.

In addition, in some arrangements, the insulating container may include a gasket or other sealing device. The gasket may be arranged in either the lid or the base and may aid in sealing the lid and base when the lid is in a closed configuration. In some examples, the gasket may be seated in a recess formed in at least one of the base and the lid and extending around a perimeter of the at least one of the base or the lid. The gasket may aid in maintaining the temperature of the liquid contained within the insulating container. One example gasket arrangement is shown in FIGS. 10A and 10B, although this and various other gasket arrangements may be used with any of the insulating containers described herein.

As shown, the gasket 560 is arranged in a recess or channel 564 in the base 502. Alternatively, the gasket 560 may be arranged in a recess or channel formed in the lid 504. When the lid 504 is in a closed configuration, a protrusion 562 having a shape corresponding to recess 564 may contact the gasket 560 and compress the gasket 560 and aid in sealing the lid and base in the closed configuration. In some arrangements, the gasket may include strategically placed cut-outs that may reduce or eliminate a need for a vent (e.g., a vent to prevent lid lock), as will be discussed more fully below.

Figure 11B:
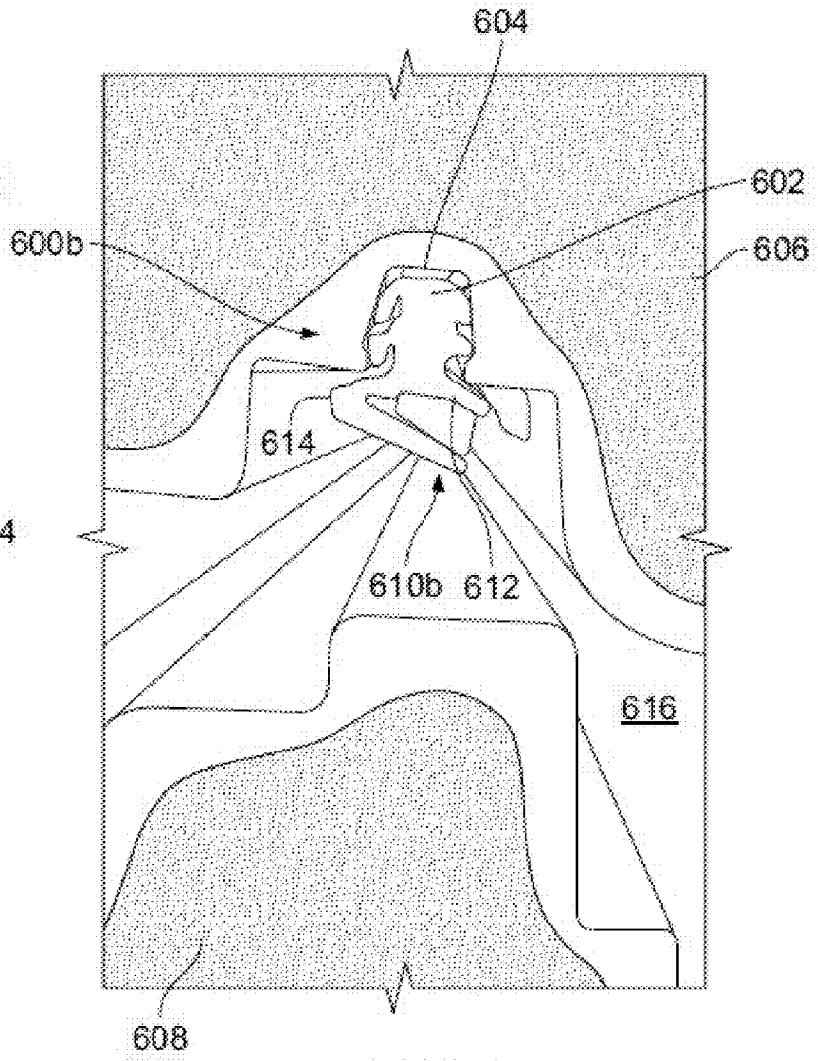
FIGS. 11A-11B illustrates one example gasket arrangement according to one or more aspects described herein.
Figure 11A:
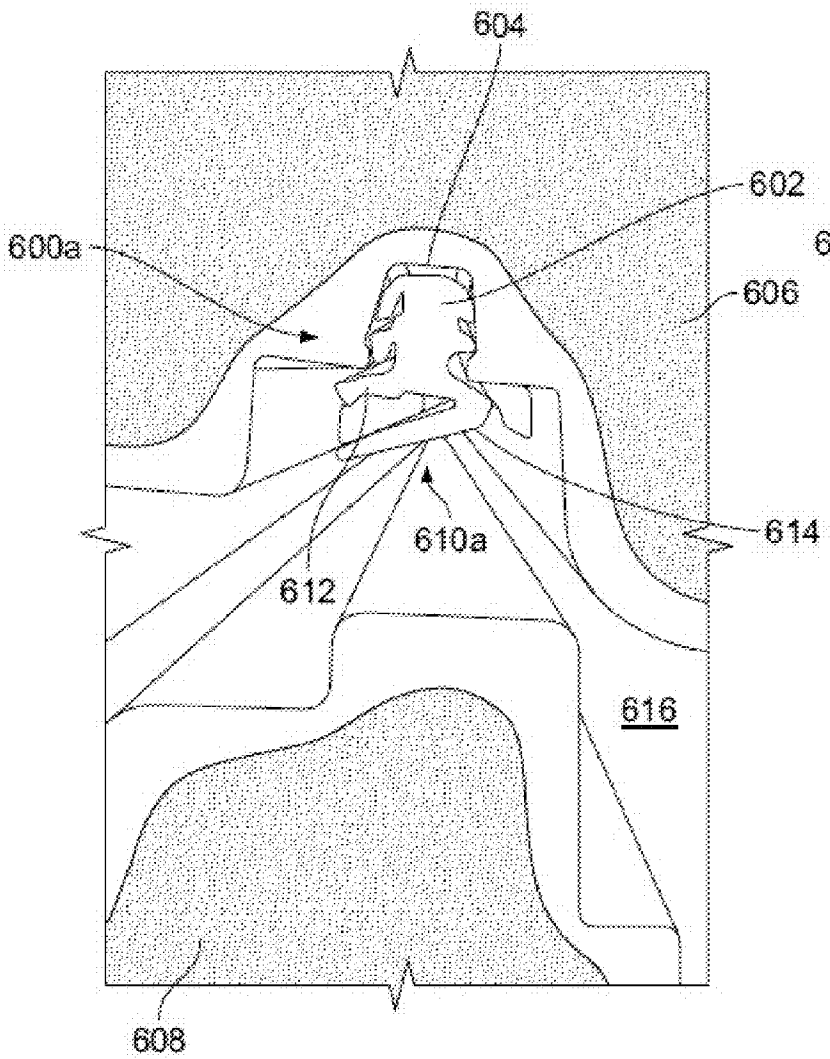

In some examples, the gasket may be a traditional gasket having a substantially circular cross section. In other examples, the gasket may have a particular cross section configured to aid in venting the insulting container. One example arrangement is shown in FIGS. 11A and 11B. The gasket 600*a*, 600*b* shown includes a base region 602 that may be received in a recess 604 in either a lid 606 or base 608 of an insulating container. The gasket 600 may include a V-shaped or substantially V-shaped portion 610 connected to the base region 602 and extending outward from the recess 604 and into a space in which the lid 606 and base 608 meet with the insulating container is in a closed configuration.

In some examples, the V-shaped portion 610 may extend generally horizontally from the base region 602. That is, the V-shaped portion 610 may include a first side of the "V" 612, that may be in contact with the base region 602 in a substantially horizontal configuration. A second side of the "V" 614 may extend from one end of the first side 612 at an angle to side 612, thereby forming a v-shaped arrangement from the two sides 612, 614.

This V-shaped arrangement may aid in permitting venting of the interior of the insulating container with the insulating container is in a closed configuration. In some examples, the V-shaped arrangement may aid in preventing leakage from the insulating container (e.g., of water or other fluids) while permitting at least some air to escape from the interior of the insulating container.

As shown in FIG. 11A, the v-shaped portion 610 may be arranged with the open area of the "V" (e.g., an end of side 612 not connected to side 614) facing away from an interior 616 of the insulating container. In another example, as shown in FIG. 11B, the open area of the "V" may face toward the interior 616 of the insulating container. In still other example, a gasket may be formed in two or more sections. The two or more sections may include portions having the "V" facing in different directions.

Figure 12:
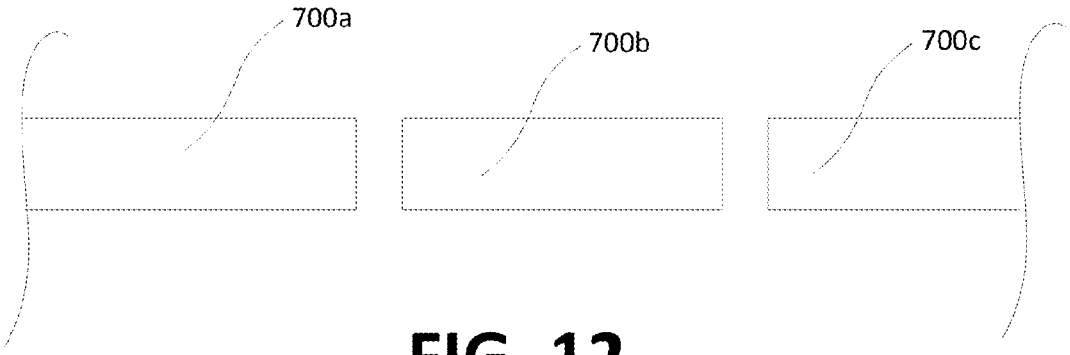
FIG. 12 illustrates one example gasket arrangement including different sections of a gasket having a "V" facing in different directions according to one or more aspects described herein.

For instance, FIG. 12 illustrates one example gasket arrangement in which different sections of gasket having a "V" facing in different directions may be used. FIG. 12 illustrates three gasket sections, 700*a*, 700*b*, 700*c*. It should be noted that, although shown as three sections, sections 700*a* and 700*c* may instead be a single gasket piece with section 700*a* representing one end of the gasket and 700*c* representing another end of the gasket.

In some examples, sections 700*a* and 700*c* may include a gasket arrangement in which the "V" portion faces the interior of the insulating container (as shown in FIG. 11B), while section 700*b* may include a gasket arrangement in which the "V" portion faces away from an interior of the insulating container (as shown in FIG. 11A). Alternatively, sections 700*a* and 700*c* may include a V portion facing away from the interior, while section 700*b* includes a V portion extending toward the interior.

Although three sections are shown in FIG. 12, more sections may also be used in such an arrangement. The additional sections may be arranged in various patterns of gasket arrangements to enhance venting of the interior of the insulating container without departing from the invention.

Figure 13:
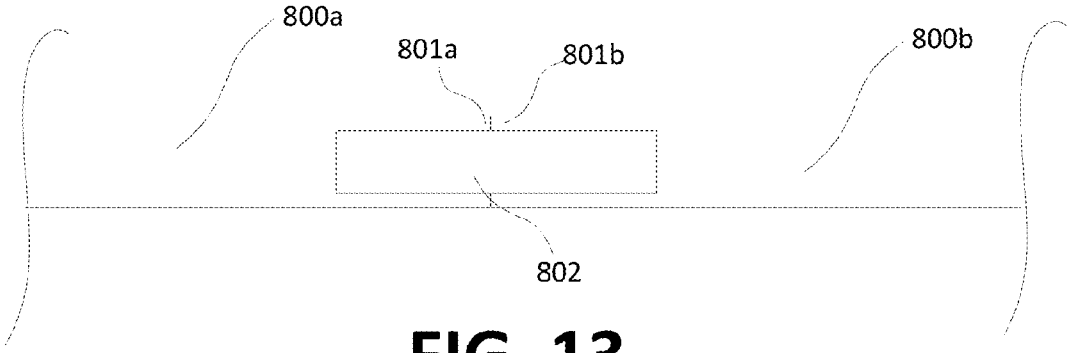
FIG. 13 illustrates another gasket arrangement which may be used in one or more insulating container configurations according to one or more aspects described herein.

FIG. 13 illustrates another gasket arrangement which may be used in one or more insulating container configurations.

The gasket shown includes a first section 800*a* and a second section 800*b*. As discussed above, sections 800*a* and 800*b* may be separate and distinct sections of gasket material or may be two ends of a single piece of gasket material. In the arrangement shown in FIG. 13, ends 801*a*, 801*b* of each section 800*a*, 800*b* may abut each other (e.g., when the gasket is installed in either a lid or base of an insulating container). To aid in maintaining the position of the gasket ends 801*a*, 801*b*, tape or other adhesive material 802 may be applied to the gasket. In some examples, the adhesive 802 may extend from section 800*a* to section 800*b* and may span abutting ends 801*a*, 801*b*.

Figure 14:
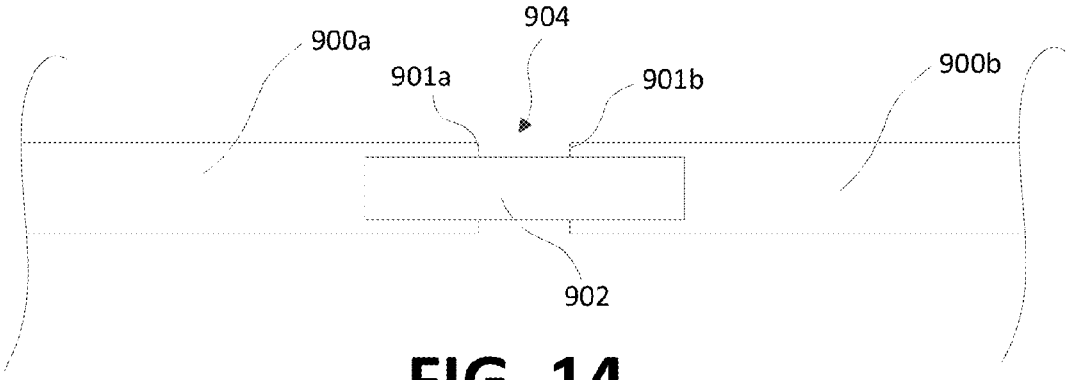
FIG. 14 illustrates yet another gasket arrangement according to one or more aspects described herein.

FIG. 14 illustrates another example gasket arrangement. Similar to the arrangement of FIG. 13, the gasket may include a first section 900*a* and a second section 900*b* which may be two distinct sections or may be opposite ends of a single section of gasket material. Unlike the arrangement of FIG. 13 in which the ends of each section are abutting, end 901*a* of section 900*a* and end 901*b* of section 900*b* are not abutting. Instead, the ends 901*a*, 901*b*, are separate from each other to define a gap 904 between each end 901*a*, 901*b*, of each section 900*a*, 900*b*. Similar to FIG. 13, an adhesive portion 902 may be used to aid in maintaining a position and/or arrangement of the gasket. The adhesive portion 902 may extend from section 900*a* to section 900*b* and may span end 901*a*, 901*b*, as well as gap 904. This arrangement may aid in providing venting means for the interior of the insulating container.

The gasket arrangements shown in FIGS. 12-14 may be used as shown in each figure or may be used in combination with each other without departing from the invention.

Additionally or alternatively, various other venting arrangements may be used without departing from the invention. For instance, a portion of the base may include a material that is breathable for air but does not permit water or other liquids to penetrate. This mesh material may allow venting without permitting spillage of the liquid contained within the insulating container.

Figure 15:
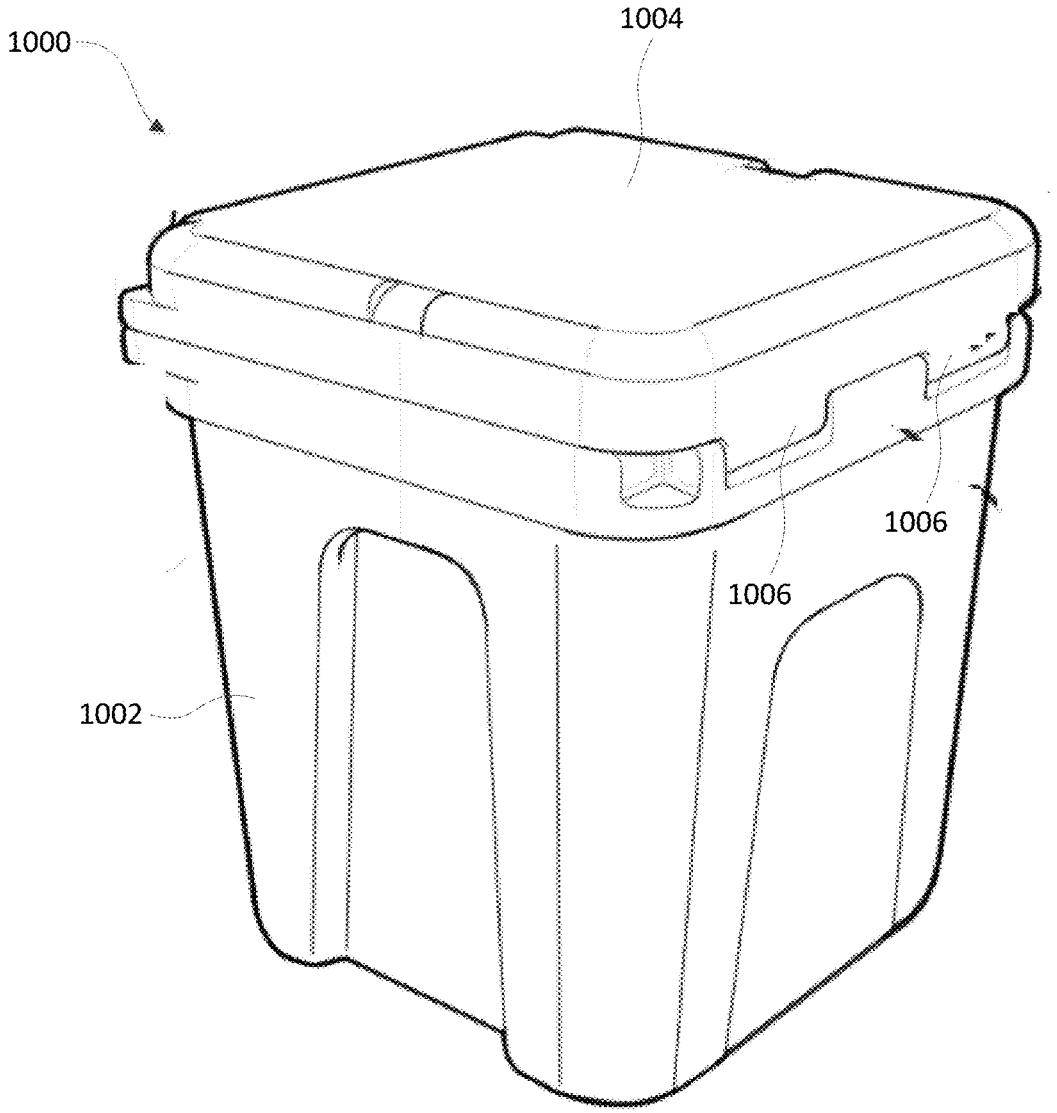
FIG. 15 illustrates another example insulating container having a hinge arrangement that permits a lid to be removed from a base according to one or more aspects described herein.

FIG. 15 illustrates another example insulating container 1000 having a hinge arrangement that permits the lid 1004 to be removed from the base 1002. The arrangement shown in FIG. 15 is merely one example of a quick release arrangement that may be used with one or more aspects of the insulating containers described herein.

As shown in FIG. 15, the insulating container 1000 includes two hinged portions 1006. The hinged portions 1006 are more clearly shown in FIGS. 16A-16C. However, the hinged portions may include an attaching member 1008 that connects to a rod or axel 1010. The rod or axel may extend across at least a portion of a top, rear of the insulating container 1000. In some examples, the rod or axel 1010 may extend across the entire span of the top, rear portion of the insulating container.

Figure 16C:
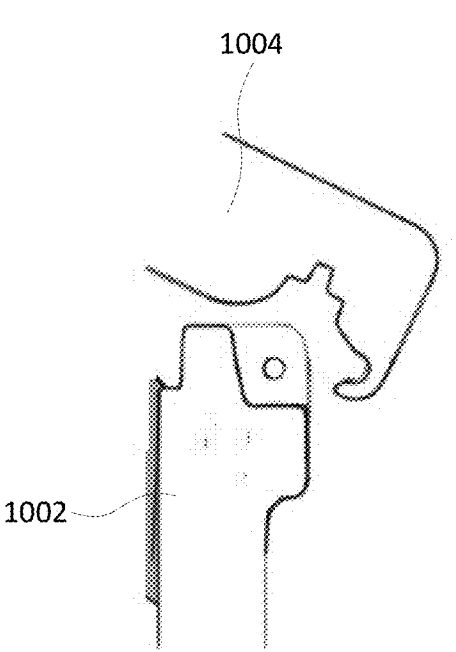
FIGS. 16A-16C illustrate one example method of removing a lid from a base of an insulating container according to one or more aspects described herein.
Figure 16B:
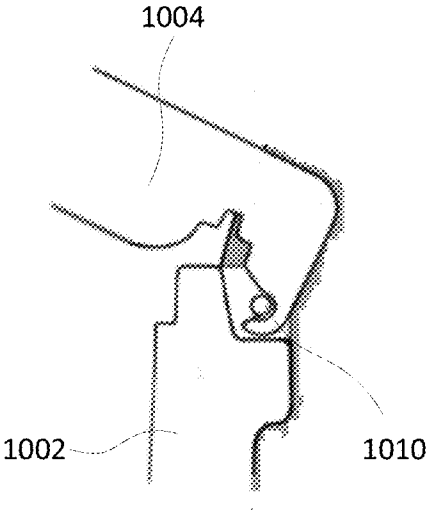
Figure 16A:
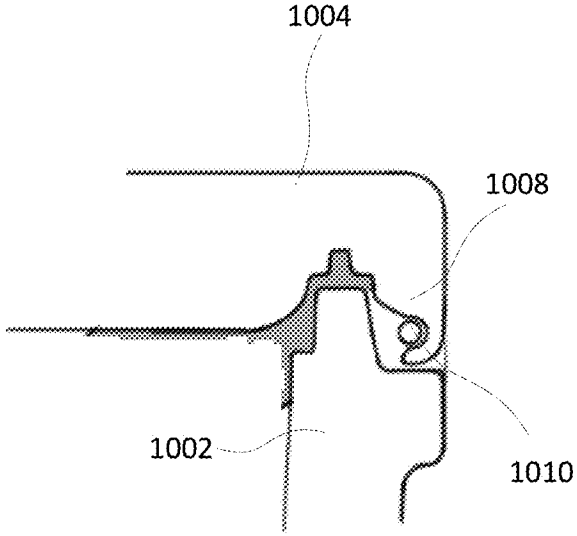

FIGS. 16A-16C illustrate one example method of removing the lid 1004 from the base 1002 of the insulating container 1000. For instance, FIG. 16A illustrates the lid 1004 in a generally closed configuration with respect to the base 1002. As the lid 1004 is pushed upward, away from the base 1002, as shown in FIG. 16B, the attaching member 1008 may rotate around rod or axel 1010. The lid 1004 may continue to be rotated until it is pulled toward a rear of the insulating container and removed from the base, as shown in FIG. 16C.

Figure 17:
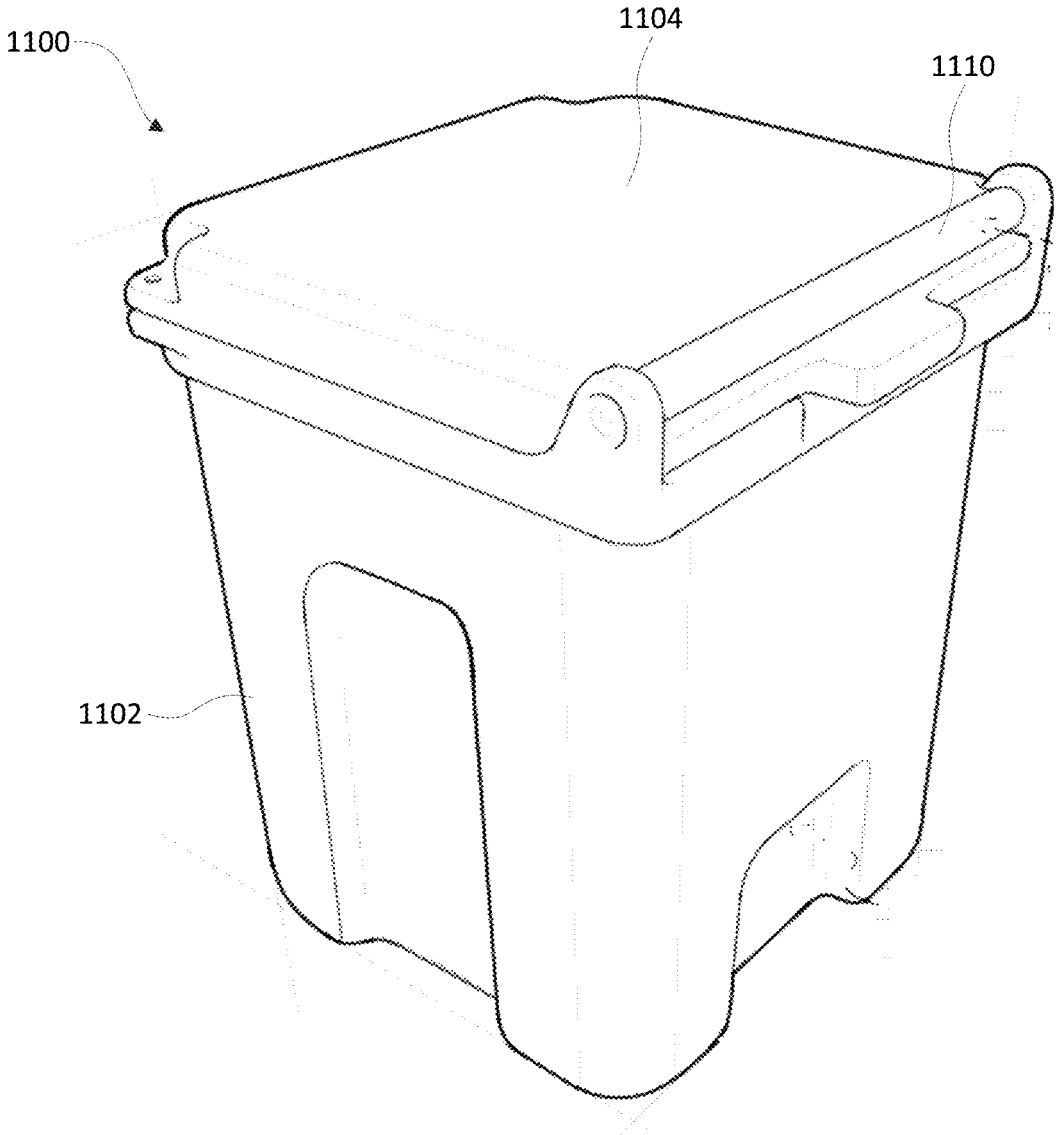
FIG. 17 illustrates yet another example of an insulating container having a removable lid according to one or more aspects described herein.
Figure 18C:
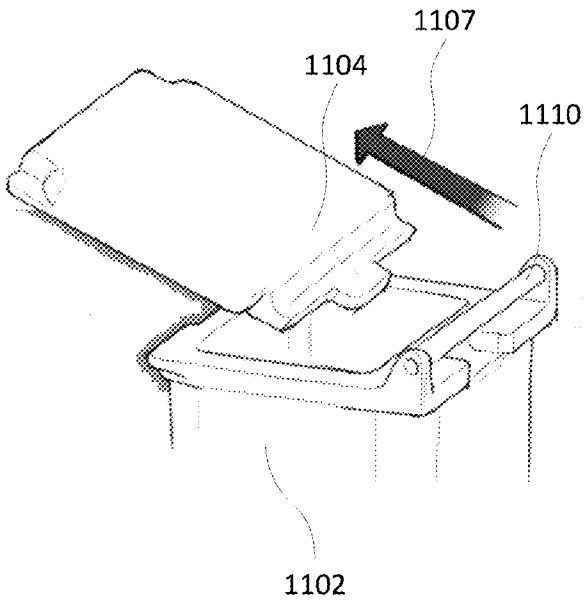
FIGS. 18A-18C illustrate one example of a lid being removed from a base according to one or more aspects described herein.
Figure 18B:
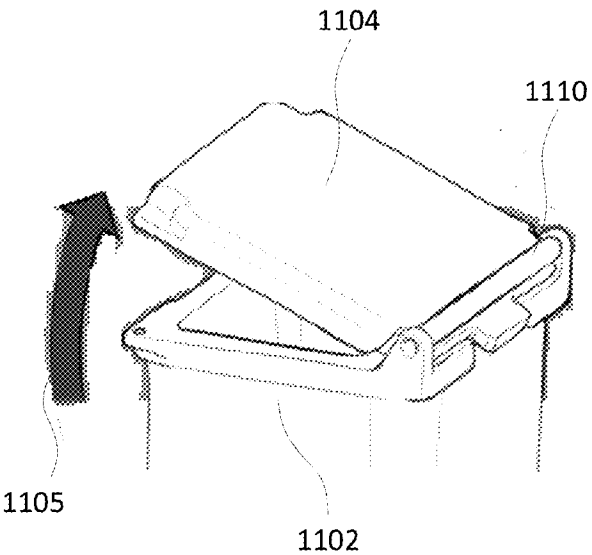

FIG. 17 illustrates yet another example of an insulating container 1100 having a removable lid. As shown in FIG. 17, the insulating container includes a lid 1104 configured to rotate about a rod or axel 1110. Upon reaching a certain point in the rotation, the lid 1104 may be removed from the base 1102, as shown in FIGS. 18A-18C.

Figure 18A:
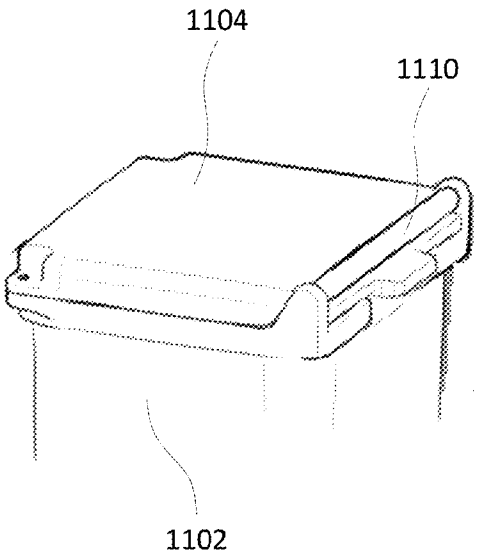
Figure 19:
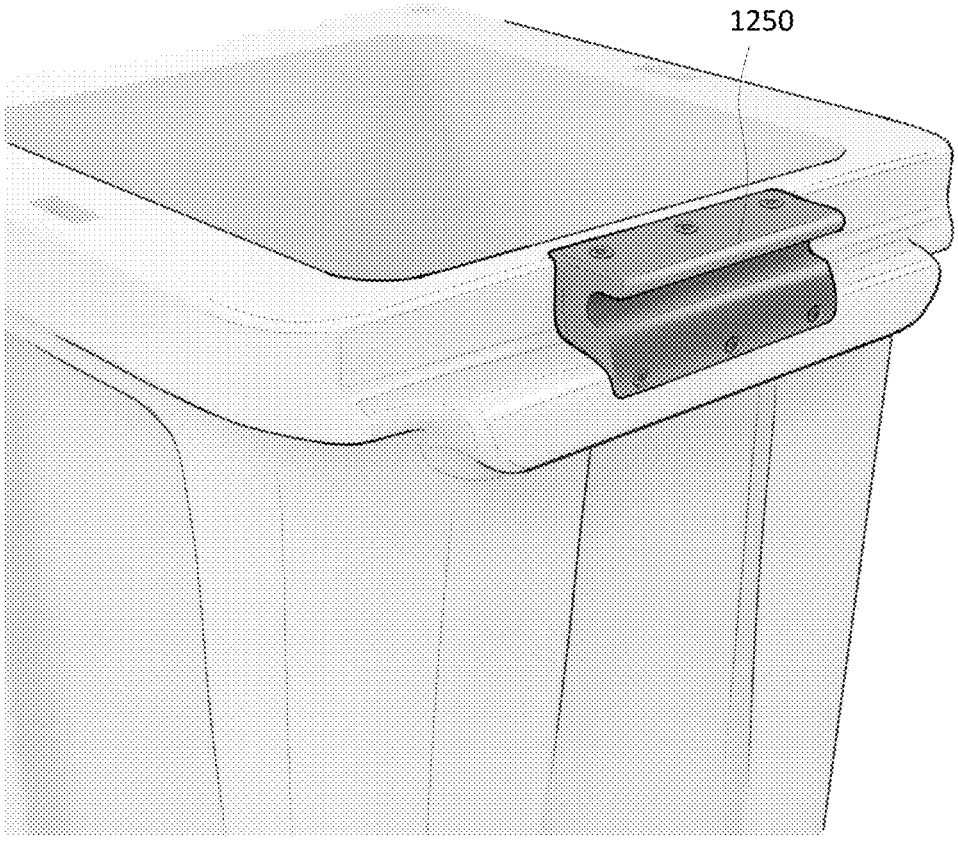
FIGS. 19-21 illustrate one example hinge insert that may be used in conjunction with one or more hinge arrangements according to one or more aspects discussed herein.
Figure 21:
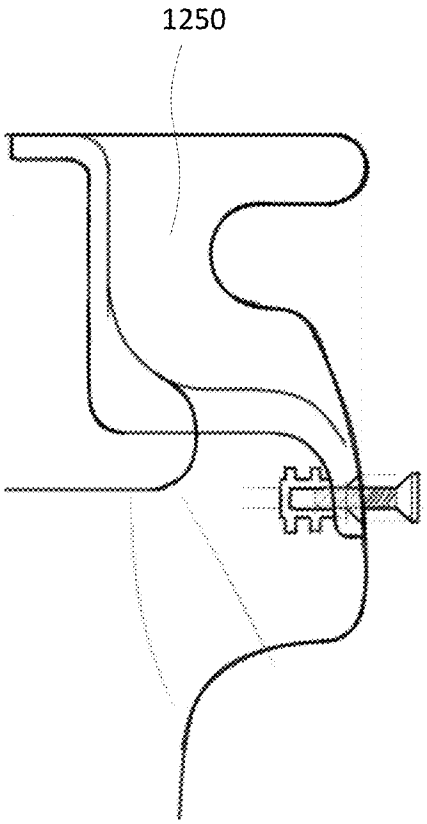
Figure 20:
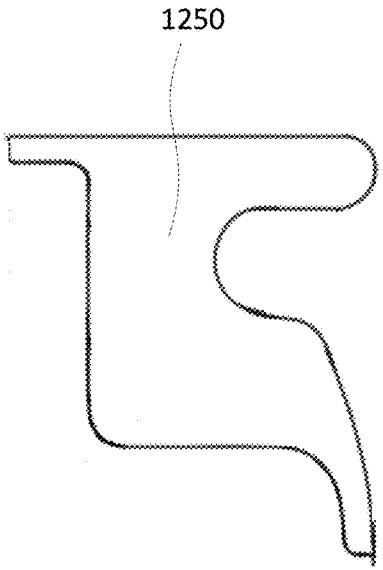

For instance, FIG. 18A illustrates the lid 1104 in a closed configuration relative to the base 1102. In FIG. 18B, the lid 1104 has been moved upward, in the direction of arrow 1105, and thereby rotates about axel 1110. Upon reaching a predetermined point in the rotation, the lid 1104 may be pulled toward a front of the insulating container 1100 (in the direction of arrow 1107) and thereby removed from the base 1102, as shown in FIG. 18C. mechanism FIGS. 19-21 illustrate one example hinge insert 1250 that may be used in conjunction with one or more hinge arrangement discussed herein.

Figure 22:
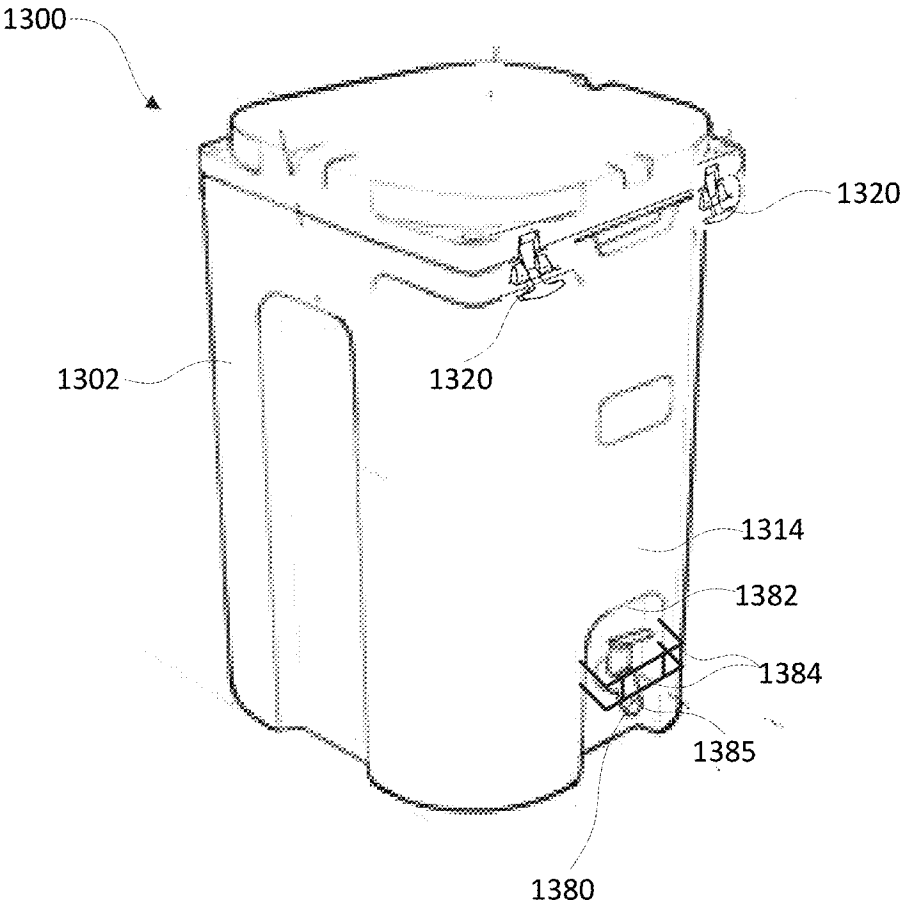
FIG. 22 illustrates another example insulating container according to one or more aspects described herein.

FIG. 22 illustrates another insulating container 1300 having various advantageous features. The insulating container 1300 may be similar to other insulating containers described herein (e.g., 100, 200, 300, 400, etc.) and may include one or more of the other features described with respect to the insulating containers described herein. For instance, the insulating container 1300 includes a lid 1304 and a base 1302. The lid 1304 may be secured to the base 1302 using latching arrangements 1320, similar to the arrangements discussed above. Further, the lid 1304 may be rotatable and/or removable relative to the base, as discussed herein.

The insulating container 1300 may include a spigot 1380. The spigot 1380 may protrude from the base 1302 and may be configured to dispense liquid stored in the insulating container. The spigot 1380 may include a valve such that, the liquid may be contained within the insulating container 1300 until a user desires to dispense a portion of the liquid (e.g., the valve defaults to an off position). The valve may then be opened to permit liquid to flow through the spigot 1380. When the desired amount of liquid is dispensed, the valve may be closed to prevent further liquid from dispensing. In some examples, the spigot 1380 may include an indicator, such as a color indicator, audible indicator, etc. to indicate when the spigot is on. Various types of spigot arrangements may be used with the insulating container without departing from the invention.

In the arrangement shown in FIG. 22, the spigot 1380 may be contained within a recess 1382 formed in the base 1302. The spigot 1380 may be mostly contained within the recess 1382 in order to protect the spigot 1380 from damage. For instance, sufficient impact with the spigot 1380 may cause it to crack or be sheared off. Accordingly, by positioning the spigot 1380 within the recess 1382, much of the spigot 1380 may be protected by the portion of the base 1302 surrounding it. In some examples, 100% of the spigot 1380 (the entire spigot) may be contained within the recess 1382 such that no portion of the spigot 1380 extends beyond an exterior surface of the base 1302. In other examples, at least 90% of the spigot 1380 may be contained within the recess (at most 10% of the spigot 580 may protrude beyond exterior wall 1314 of the base 1302), at least 75% of the spigot 1380 may be contained within the recess (with 25% protruding outward from exterior wall 1314), at least 50% may be contained within the recess (with 50% protruding outward from exterior wall 1314), at least 30% may be contained within the recess (with 70% protruding outward from exterior wall 1314), and the like.

Additionally or alternatively, the insulating container 500 may include one or more guards 1384 that may be used to protect spigot 1380. For instance, the guard 1384 may extend outward from an edge of the recess 1382, over the spigot, to an opposite edge of the recess 1382. Accordingly, any object or force directed at the spigot 1380 would be intercepted by the guard 1382. The guard 1384 may be molded into the base 1302 or may be formed separately from the base 1302 and connected to the base 1302. The guard 1384 may be connected to the base 1302 using fasteners, a snap fit, adhesives, or the like. In some examples, the guard 1384 may be formed of various plastics, metals such as aluminum, steel, etc., composites, and the like.

In arrangements including a plurality of guards 1384 (such as FIG. 22), the guards may be arranged such that portions of each guard extend parallel or substantially parallel to other guards 1384. In some examples, the guard may include one or more portions 1385 extending perpendicularly between parallel guards 1384. This may provide additional protection of the spigot 1380 from small objects such as rocks, stones, or the like.

The guard 1384 may be arranged around the spigot 1380 such that it does not interfere with operation of the spigot 1380. For instance, a user may be able to easily access the valve portion of the spigot 1380 to dispense liquid or cease dispensing liquid. Further, in arrangements in which the user may be filling a container such as a cup, water bottle, or the like, from the spigot 1380, the guard 1384 may be arranged above the spout portion of the spigot 1380 so as not to interfere with placement of the container.

Figure 24:
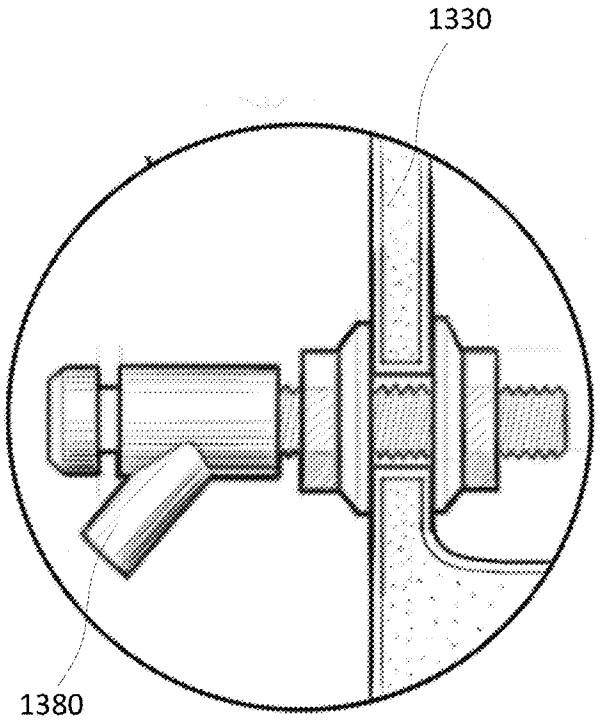
FIGS. 23 and 24 illustrate various spigot arrangements according to one or more aspects described herein.
Figure 23:
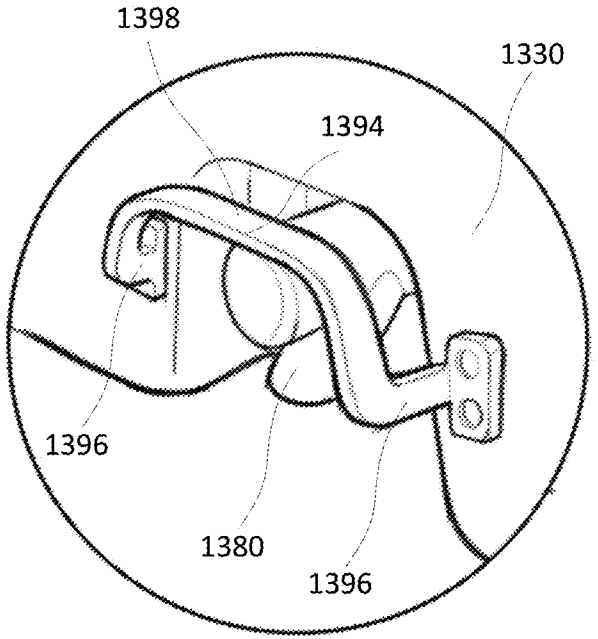

FIGS. 23 and 24 illustrate another spigot guard arrangement 1394. The spigot 1380 shown may be any suitable type of spigot 580 and, as shown in FIG. 24, may protrude through a sidewall 1330 of the insulating container. In some examples, one or more portions of the spigot 1380 may be formed of stainless steel, aluminum, composite, synthetic materials such as NYLON, and the like.

The spigot arrangements shown in FIGS. 23 and 24 are shown in isolation. However, the spigot shown 1380 may be used in various types of insulating containers, including those described herein.

With further reference to FIG. 23, the spigot guard 1394 protrudes outward from the sidewall 1330 of the insulating container. The spigot guard 1394 includes two side portions 1396 that extend from the sidewall 1330 and a center portion 1398 joining one end of each of the two side portions 1396. In some examples, as shown in FIG. 23, the spigot guard 1394 may have curved portions where the side portion 1396 meets an end of the center portion 1398. In other arrangements, the connection may be made at an angle, such as a right angle.

The center portion 1398 extends over a top of the spigot 1380 in order to protect the spigot 1380 from damage. For instance, an article falling near the insulating container or thrown at the insulating container may break a spigot in a conventional arrangement. However, the spigot guard 1394 may protect the spigot from object that may cause damage to the spigot.

In some examples, the spigot guard 1394 may be integrally molded in a the sidewall 1330 of the insulating container (e.g., one piece with the sidewall or base). In another example, the spigot guard 1394 may be formed as a separate piece and joined to the sidewall 1330 via fasteners, adhesives, and the like.

Figure 26:
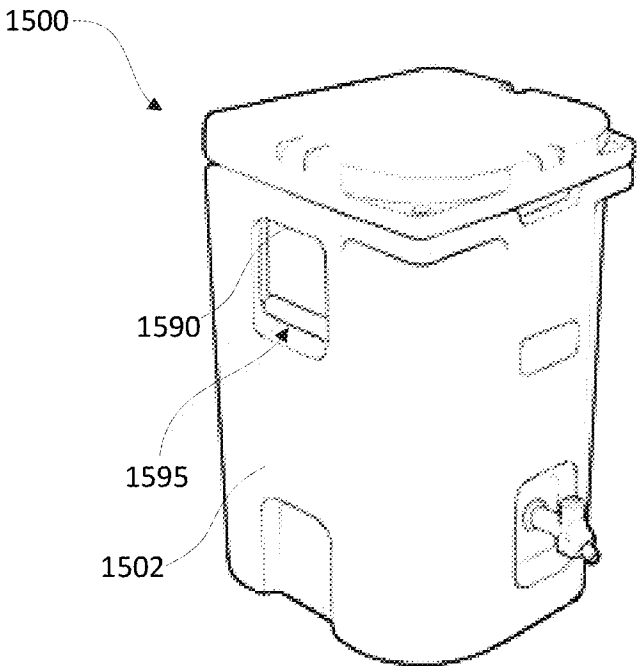
FIGS. 25-27 illustrate various handle arrangements that may be used with one or more of the insulating containers described herein.
Figure 25:
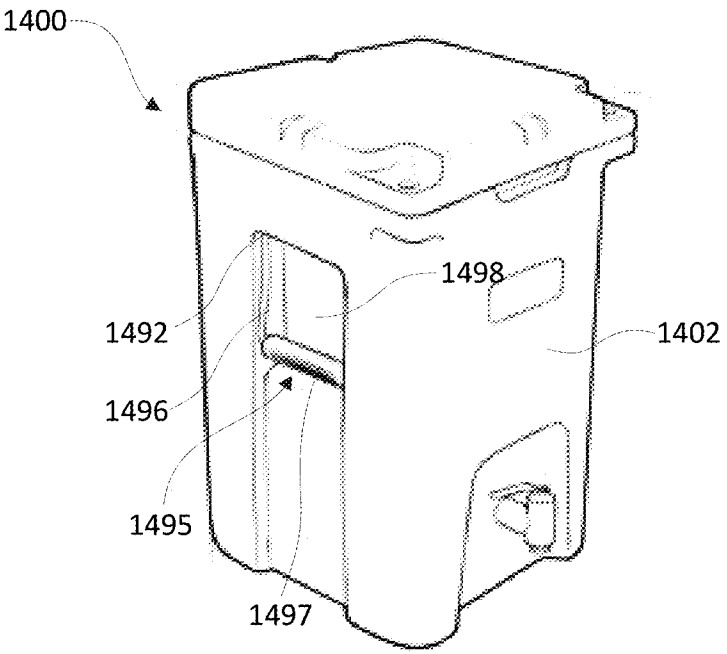
Figure 27:
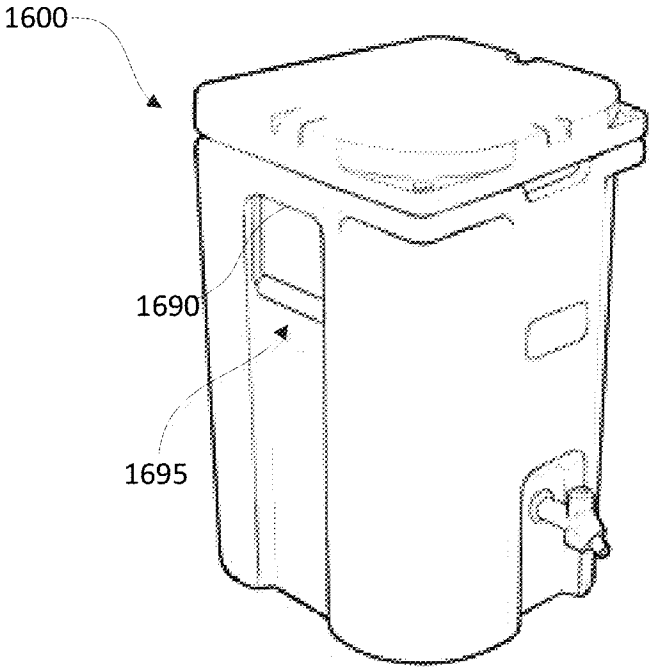

In some examples, as discussed above, an insulating container may have one or more handles formed in the base portion. FIGS. 25-27 illustrate various additional handle arrangements that may be used with one or more of the insulating containers described herein. For instance, FIG. 25 illustrates an insulating container 1400 having a handle arrangement 1492 formed in base 1402. The handle arrangement includes an undercut 1492 molded into the base portion 1402. Because the undercut handle 1492 is integrally molded with the base 1402, the handle is not likely (or less likely) to be broken (e.g., if the insulating container is dropped, struck, or the like). For instance, the undercut handle 1492 is formed flush with an exterior surface of the base 1402. Accordingly, no portion of the handle 1492 protrudes outward from the base 1402. Handles that protrude outward from the base may be more likely to be broken, etc. Although undercut handle 1492 is shown on one side of base 1402, a second undercut handle may be formed on an opposite side of the base 1402 to permit even carrying of the insulating container.

In some examples, the insulating container 1400 may include a second handle arrangement 1495 in addition to the undercut handle 1492. For instance, the insulating container may include secondary handle 1495 that may be a piece formed separately from the base 1402 and connected thereto. In some examples, the handle 1495 may be connected to the base 1402 at each of two stem portions 1496 (only one stem portion is visible in FIG. 25, however a second stem portion may extend from opposite end of cross bar 1497). The two stem portions may be connected by a cross bar 1497 which may form the hand engaging portion. The handle 1495 may pivot with respect to the base 1402 such that, when not in use, the handle may be received in recess 1498 formed in side wall of base 1402. When in use, the handle 1495 may be rotated outward from the recess 1498 such that a user may grip the cross bar 1497 to carry the insulating container.

In some arrangements, handle 1495 may be formed of various suitable materials, such as one or more plastics. For instance, the handle 1495 may have a core formed of polyvinyl chloride and an outer portion formed of ethylene vinyl acetate. Although the handle 1495 is shown in FIG. 25 as having a solid structure, in some arrangements, the handle 1495 may have less structure and, instead may be formed of rope (such as polyester rope) that may be durable.

Although the arrangement of FIG. 25 includes both handle 1492 and handle 1495, in some examples, the insulating container 1400 may include only handle 1492 or only handle 1495.

FIG. 26 illustrates another handle arrangement according to one or more aspects described herein. The insulating container 1500 may be substantially similar to the various other insulating containers described herein and may include one or more features discussed with respect to other insulating containers described herein.

Insulating container 1500 may include an undercut handle 1590 formed in the base 1502. Similar to handle 1492, handle 1590 may be flush with the exterior surface of the base 1502 to avoid breakage of the handle. In some arrangements, insulating container 1500 may include a secondary handle arrangement 1595. Secondary handle 1595 may be similar to handle 1495 discussed with respect to FIG. 25.

FIG. 27 illustrates yet another insulating container 1600 arrangement. The insulating container 1600 may be similar to various other insulating containers described herein and may include one or more features described with respect to those insulating containers.

Similar to insulating containers 1400 and 1500 shown in FIGS. 25 and 26, respectively, insulating container 1600 includes an undercut handle 1690, as well as a secondary handle arrangement 1695. In some examples, the insulating container 1600 may include only the undercut handle 1690.

Figure 28:
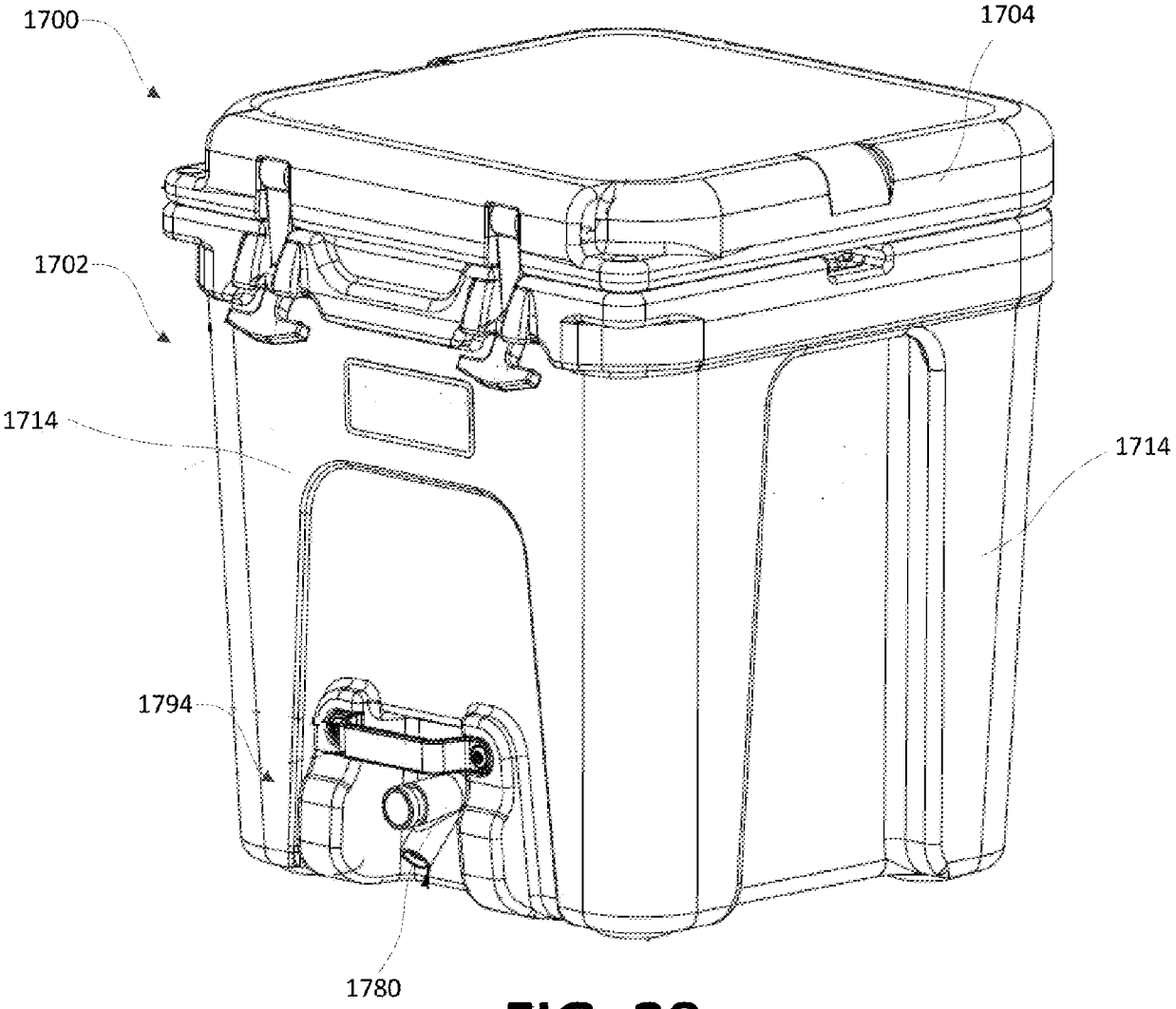
FIG. 28 illustrates one example insulating container having one example spigot and spigot guard arrangement according to one or more aspects described herein.

FIG. 28 illustrates one example insulating container 1700 having one example spigot 1780 and spigot guard 1784 arrangement according to one or more aspects described herein. The example spigot 1780 and/or spigot guard 1784 arrangements described herein may be used alone or in combination with various different insulating containers and are not limited to use only with the insulating container shown in the figures or described herein.

Similar to one or more other arrangements described herein, the insulating container 1700 may include a base portion 1702 having a plurality of sides 1714 forming a sidewall structure and a bottom portion (not shown in FIG. 28). The sidewall structure and bottom portion forming the base 1702 may define an interior void of the insulating container (similar to various other interior void arrangements discussed herein). The insulating container 1700 may, in at least some examples include a lid 1704. Similar to one or more other arrangements described herein, the insulating container 1700 may include a spigot 1780 extending through a side 1714 of the base portion 1702 and between an interior void of the insulating container 1700 and an exterior of the insulating container 1700. The spigot 1780 may be configured to permit and/or control a flow of fluid stored in the interior void in the insulating container from the interior void to an exterior of the insulating container 1700 (e.g., to dispense fluid). The spigot 1780 will be discussed more fully with respect to FIGS. 29-32.

Figure 32:
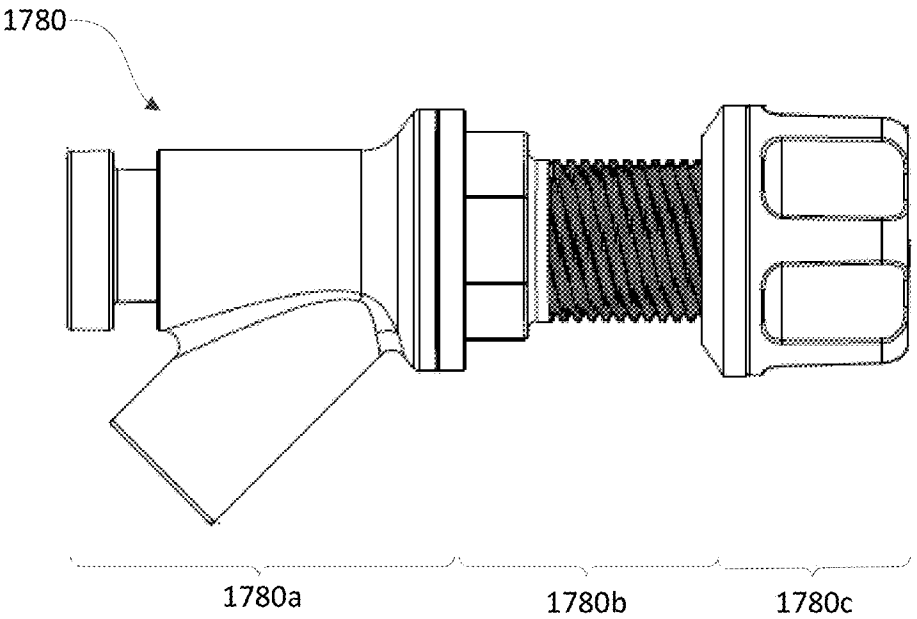
FIG. 32 is a side view of the example spigot of FIG. 29 shown in isolation.
Figure 31:
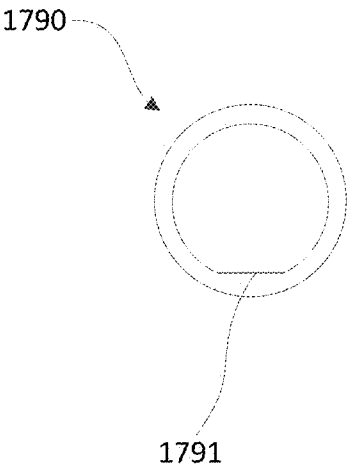
FIG. 31 is a front view of an aperture formed in a portion of a spigot body according to one or more aspects described herein.

As shown in FIG. 32, the spigot 1780 may generally include three regions. A first region 1780*a* may extend outward from an exterior of a side 1714 of the insulating container 1700. A second region 1780*b* may extend through a side 1714 of the insulating container 1700 (e.g., may be within the sidewall of the insulating container and, thus, not generally visible when the spigot 1780 is installed). A third region 1780*c* may extend from an interior of a side 1714 of the insulating container inward, toward the interior void of the insulating container.

As shown in FIGS. 29-32, the spigot 1780 may be configured to be disassembled and removed from the insulating container (e.g., for cleaning, etc.) and reassembled within the insulating container 1700. For instance, the spigot 1780 may include a spigot body 1785 having a spout 1782 extending therefrom (e.g., downward, at an angle) for dispensing fluid. The spigot body 1785 may be configured to house portions of the spigot assembly, such as a spring 1786, portions of a spigot valve rod 1787, and the like, when the spigot 1780 is assembled in the insulating container 1700.

In some examples, the spigot valve rod 1787 (when assembled) may extend through the spigot body 1785 when assembled, through the spring 1786, and may thread (e.g., via end threaded region 1788 shown in FIG. 30) into a dispensing button 1781. The button 1781 may include a finger engaging portion 1781*a* which a user may depress in order to dispense fluid. The button 1781 may further include an interior portion 1781*b* which may be configured to be received in an aperture 1790 formed in an end of the spigot body 1785.

In some examples, the aperture 1790 may include one or more flat portions (e.g., flat portion 1791 shown in FIG. 31) which may prevent the button 1781 from rotating during use. For instance, when assembled, interior portion 1781*b* of the button 1781 may be received in aperture 1790 and may contact an interior of the aperture, including flat portion 1791. Accordingly, any attempted rotation of the button, either during use or assembly, may be reduced or prevented by the flat portion 1791 contacting the interior portion 1781*b* of the button 1781. Although one flat portion 1791 is shown, additional flat portions may be used or other shapes which may prevent turning of the button 1781 may be used without departing from the invention.

Figure 30:
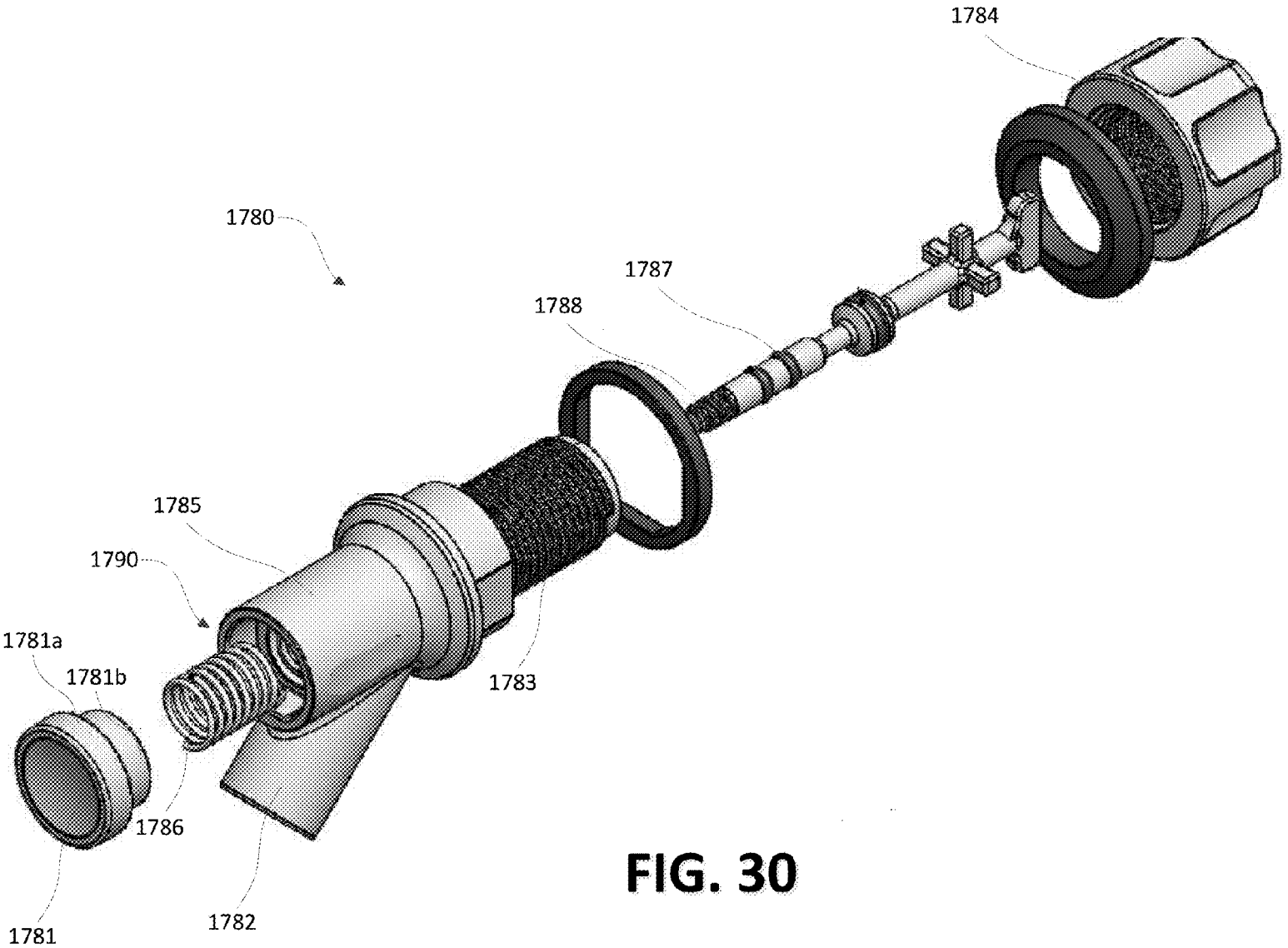
FIG. 30 is an exploded view of the example spigot of FIG. 29.

Assembly of the spigot 1780 will be discussed with reference to FIG. 30. As mentioned above, the spigot assembly 1780 may be configured to be disassembled and reassembled to permit cleaning of one or more parts of the spigot assembly 1780. Assembly of the spigot 1780 may involve extending the spigot valve rod 1787 through a wall 1714 of the insulating container 1700 and through the spigot body 1785 and spring 1786 and into the button 1781. The threaded end 1788 of the threaded valve rod may screw into or otherwise connect to the button 1781 when assembled. For instance, threaded portion 1788 of spigot valve rod 1787 may be received by a mating threaded portion on an interior of the button 1781.

Figure 29:
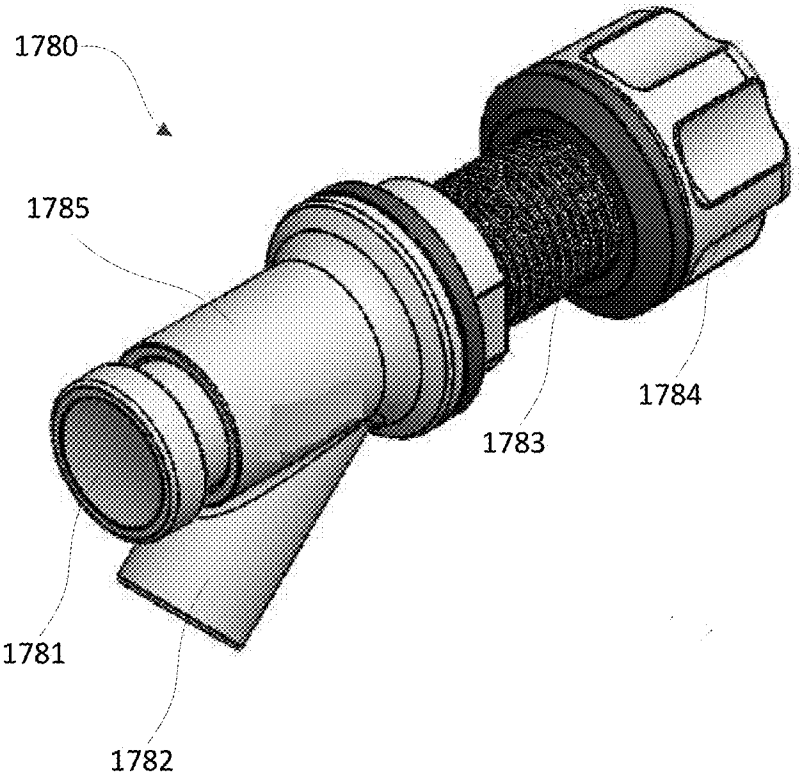
FIG. 29 illustrates one example spigot that may be used with one or more aspects described herein.

The spigot nut 1784 may be connected to the spigot assembly 1780 from an interior of the insulating container 1700 to connect the spigot 1780. For instance, the spigot nut 1784 may be threaded onto threaded portion 1783 of the spigot body 1785 to fix the spigot assembly 1780 in place within the insulating container 1700. An assembled spigot assembly (shown in isolation without the insulating container) is shown in FIGS. 29 and 32.

The spigot assembly 1780 and portions thereof may be formed of various suitable materials. For instance, one or more components of the spigot assembly may be formed of stainless steel, plastic, composite, or other suitable materials.

With further reference to FIG. 28, the insulating container 1700 may include a spigot guard 1794. The spigot guard 1794 shown may be used in combination with the spigot assembly 1780 shown, with another spigot assembly, or the like. The spigot guard 1791 may be arranged on a same side 1714 of the insulating container as the spigot 1780 and may be configured to protect the spigot 1780 in case the insulating container 1700 is receives an impact force (e.g., is dropped, is struck, or the like). The spigot guard 1794 will be discussed more fully herein with respect to FIGS. 33-36.

For instance, the spigot guard 1794 may be arranged on a side 1714 of the insulating container 1700 in a location proximate the spigot 1780. In some arrangements, the spigot guard 1794 may include spigot side guards 1795*a*, 1795*b* and a spigot cross guard 1796.

Figure 34:
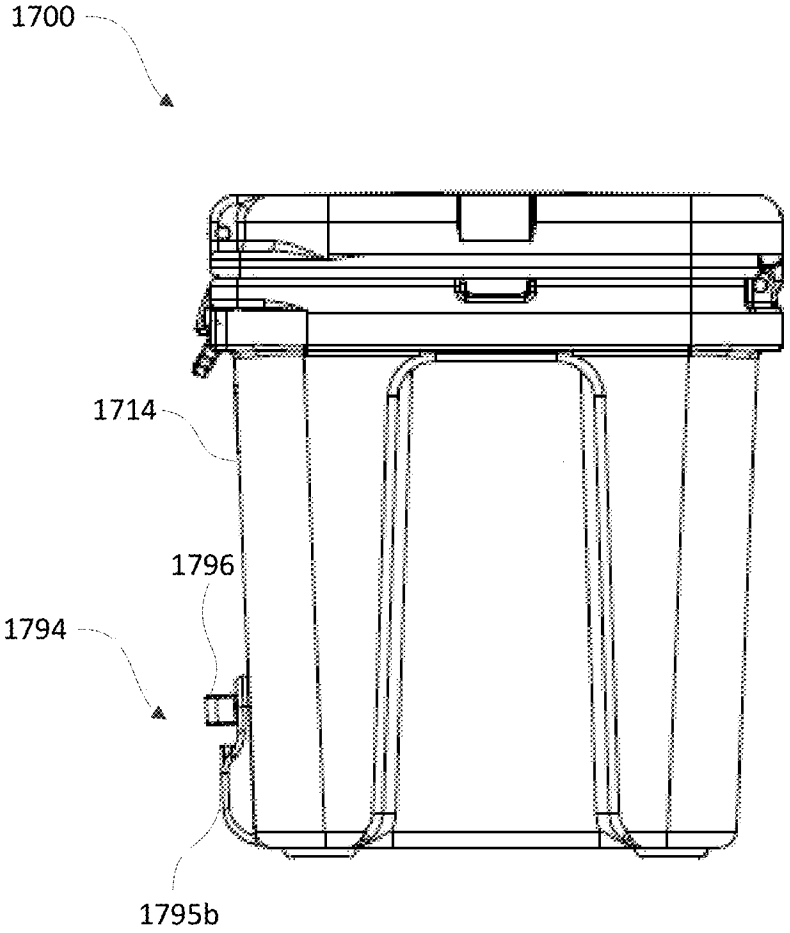
FIG. 34 is a side view of the insulating container of FIG. 33.
Figure 33:
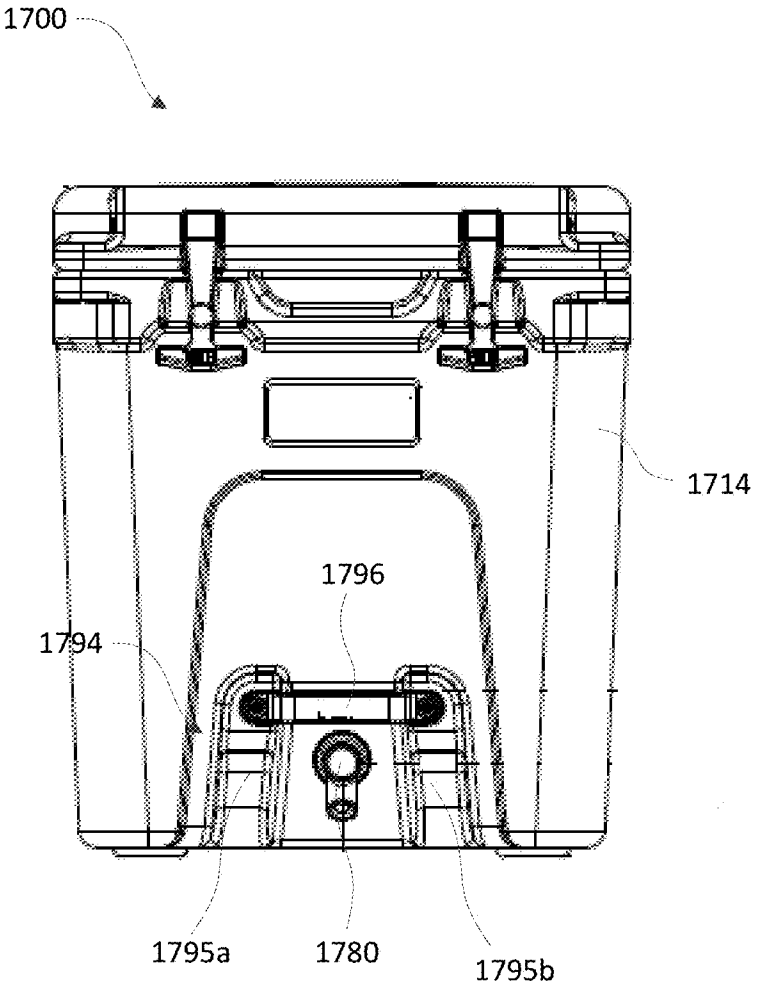
FIG. 33 is a front view of an insulating container including one example spigot and spigot guard assembly described herein.
Figure 35:
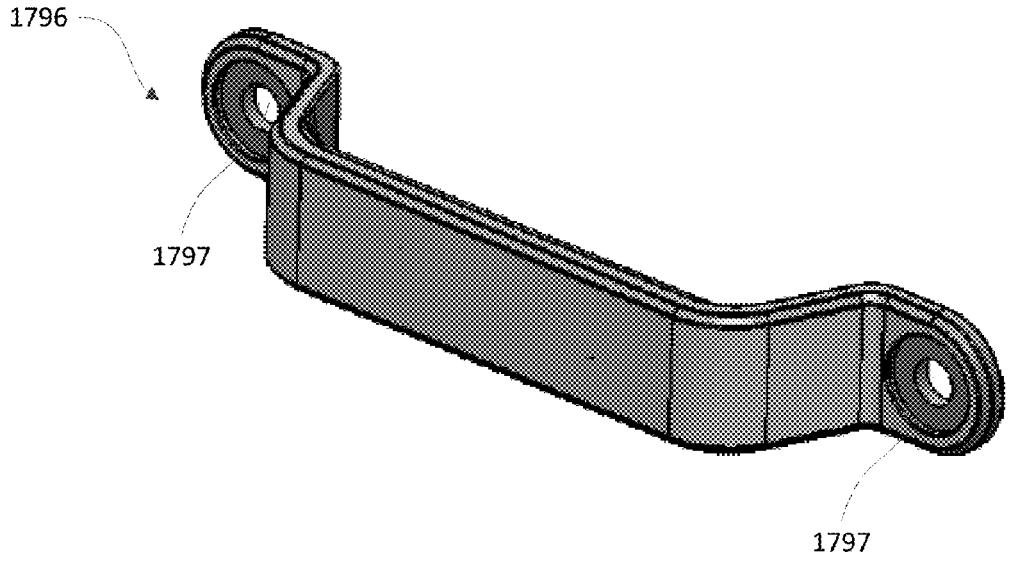
FIG. 35 is a perspective view of a portion of an example spigot guard according to one or more aspects described herein.
Figure 36:
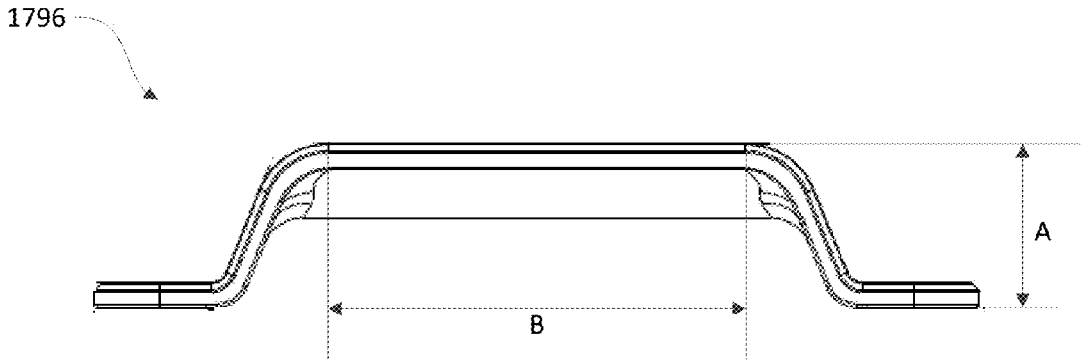
FIG. 36 is a top view of the portion of the spigot guard shown in FIG. 35.

For instance, as shown in, for example, FIGS. 33 and 34, spigot guard 1794 may include two spigot side guards 1795*a*, 1795*b* arranged on either side of a spigot region (e.g., a region from which the spigot 1780 protrudes from the insulating container 1700). In some examples, the spigot side guards 1795*a*, 1795*b* may be integrally formed the base portion (e.g., sidewall structure, wall, etc.) of the insulating container 1700. For instance, the spigot side guards 1795*a*, 1795*b* may be molded into the side 1714 of the insulating container 1700 when the insulating container is formed. Accordingly, in some examples, the spigot side guards 1795*a*, 1795*b* may be formed as a single piece with the base of the insulating container 1700. This may aid in efficiently manufacturing the insulating container. In addition, the spigot side guards 1795*a*, 1795 may be formed as solid portions of material or may be formed as hollow guards to permit additional insulating to be provided in a void created by the hollow side guards 1795*a*, 1795*b*. The spigot side guards 1795*a*, 1795*b* may be double-walled, similar to the double-walled arrangements used in the base 1702 and/or lid 1704.

As shown in the figures, the spigot side guards 1795*a*, 1795*b* may protrude outward from the side 1714 of the insulating container 1700. For instance, at least a portion of the spigot side guards 1795*a*, 1795*b* may protrude outward, from an exterior surface of the side 1714 of the insulating container 1700 in order to protect the spigot 1780 from, for example, a shear force. In some arrangements, the spigot side guards 1795*a*, 1795*b* may protrude outward between 50 and 60 millimeters from the exterior surface of the side 1714.

In some examples, the spigot side guards 1795*a*, 1795*b* may taper from one end of the side spigot guard 1795*a*, 1795*b* to an opposite end of the side spigot guard 1795*a*, 1795*b*. For instance, as shown in at least FIG. 34, the spigot side guard 1795*b* may extend a greater distance outward from the side 1714 of the insulating container 1700 at an end proximate a bottom of the insulating container 1700 than at an end distal the bottom of the insulating container 1700. This streamlined arrangement may accommodate the spigot cross guard 1796.

For instance, as mentioned above, the spigot guard 1794 may include a spigot cross guard 1796. As shown in the figures, the spigot cross guard 1796 may extend horizontally across a spigot region and between the first spigot side guard 1795*a* and the second spigot side guard 1795*b*. The spigot cross guard 1796 may protect the spigot from, for example, objects falling downward onto the spigot 1780.

In some examples, the spigot cross guard 1796 may be formed as a component separate from the remainder of the insulating container 1700 or base 1702 of the insulating container 1700. The spigot cross guard 1796 may then be connected to the base 1702 via one or more fasteners, such as screws, adhesives, or the like. For instance, screws or other fasteners may extend through apertures 1797 in the spigot cross guard 1796 to connect the spigot cross guard 1796 to the base 1702 of the insulating container 1700.

The spigot cross guard 1796 may be formed of one or more suitable materials, such as various metals, including aluminum, stainless steel, and the like. In some examples, the spigot cross guard 1796 may be formed of one or more plastics or composite materials.

In some examples, portions of the spigot cross guard 1796 may extend outward from the exterior surface of the side 1714 of the insulating container 1700. For instance, the spigot cross guard 1796 may have a tapered arrangement such that a first end and a second end are substantially flush with and/or in contact with the exterior surface of the side 1714, while a central portion extending between the first end and the second end may protrude outward, away from the exterior surface of the side 1714, thereby forming a gap between the spigot cross guard 1796 and the exterior surface of the side 1714 of the insulating container. In some examples, the exterior surface of the side 1714 may correspond to a recessed area in which the spigot 1780 is arranged. Accordingly, in these example arrangements, the gap may be formed between the spigot cross guard 1796 and the recessed exterior surface of the side 1714 of the insulating container.

In some examples, this gap may be sufficiently sized to be used as a handle for lifting the insulating container 1700. For instance, the distance A between an exterior surface of the central region of the spigot cross guard 1796 and an interior facing surface of the first end and the second end of the spigot cross guard 1796 may be between 0.75 and 2.0 inches. Further, a length B of the central portion of the spigot cross guard 1796 may be between 2 inches and 6 inches, in some example arrangements.

The spigot and spigot guard arrangements may be used in combination with one or more other aspects of various insulating containers including, for example, the insulating containers described herein. As discussed herein, the spigot arrangement allows for ease of assembly/disassembly in order to facilitate cleaning of the spigot. Further, the spigot guard arrangements may aid in preventing or reducing damage to the spigot in the event the insulating container is struck, dropped, falls, etc. For instance, the shape and position of the spigot side guards may aid in reducing or preventing damage to the spigot in the event the insulating container is subjected to, for example, a side force or front face force. The spigot cross guard may aid in preventing or reducing damage to the spigot in the event the insulating container is subjected to, for example, a downward force along a front face or a front face force. The spigot guard arrangements described herein may aid in preventing or reducing damage to the spigot from additional forces or force directions.

The insulating containers described herein include various features that ensure easy and efficient manufacture of the insulating containers, while providing durability and wear resistance. The insulating containers and the various integrally molded features, such as handles, a spigot recess, spigot guard, etc., may be advantageous in improving durability and wear resistance. Further, the various lid arrangements described herein may aid in securing the lid to the base in both the open configuration and closed configuration, and may aid in avoiding breakage and/or loss of a lid.

The present disclosure is disclosed above and in the accompanying drawings with reference to a variety of examples. The purpose served by the disclosure, however, is to provide examples of the various features and concepts related to the disclosure, not to limit the scope of the invention. One skilled in the relevant art will recognize that numerous variations and modifications may be made to the examples described above without departing from the scope of the present disclosure.

We claim:

1. An insulating container, comprising:

a base including:

a sidewall structure having a plurality of sides;

a bottom portion connected to a first end of each side of the plurality of sides of the sidewall structure, the bottom portion being configured to support the insulating container on a surface; and an opening formed at a second end of each side of the plurality of sides of the sidewall structure, opposite the first end of each side of the plurality of sides of the sidewall structure, the opening being configured to allow access to an interior void of the insulating container formed by the sidewall structure and the bottom portion; and a spigot extending through a first side of the sidewall structure, the spigot configured to dispense fluid stored in the interior void, the spigot further including:

a spigot body including a spout for dispensing the fluid;

a threaded valve rod extending through the spigot body and having a threaded end configured to mate with a spigot button; and the spigot button configured to control a flow of fluid from the interior void, the button being connected to the threaded end of the threaded valve rod.

2. The insulating container of claim 1, the spigot further including a spring arranged within the spigot body and configured to be engaged by the spigot button to dispense fluid from the interior void.

3. The insulating container of claim 1, further including a lid configured to mate with the base and cover the opening formed at the second end of each side of the plurality of sides of the sidewall structure.

4. The insulating container of claim 3, further including at least one latching device configured to latch the lid to the base.

5. The insulating container of claim 1, the spigot further including a spigot nut arranged in the interior void and connected to a threaded portion of the spigot body.

6. The insulating container of claim 1, the spigot body further including an aperture formed in a first end of the spigot body and configured to receive a portion of the spigot button.

7. The insulating container of claim 6, wherein the aperture formed in the first end of the spigot body includes a substantially circular portion and a flat portion.

8. The insulating container of claim 1, further including a spigot guard located proximate the spigot.

9. The insulating container of claim 8, the spigot guard including:

a plurality of spigot side guards; and a horizontal spigot cross guard.

10. The spigot of claim 1, further including a spring arranged within the spigot body and configured to be engaged by the spigot button to dispense fluid.

11. The spigot of claim 1, further including a spigot nut connected to a threaded portion of the spigot body.

12. The spigot of claim 1, the spigot body further including an aperture formed in a first end of the spigot body and configured to receive a portion of the spigot button.

13. The spigot of claim 12, wherein the aperture formed in the first end of the spigot body includes a substantially circular portion and a flat portion.

14. An insulating container, comprising:

a base including:

a sidewall structure having a plurality of sides;

a bottom portion connected to a first end of each side of the plurality of sides of the sidewall structure, the bottom portion being configured to support the insulating container on a surface; and an opening formed at a second end of each side of the plurality of sides of the sidewall structure, opposite the first end of each side of the plurality of sides of the sidewall structure, the opening being configured to allow access to an interior void of the insulating container formed by the sidewall structure and the bottom portion;

a spigot extending through a first side of the sidewall structure, the spigot configured to dispense fluid stored in the interior void; and a spigot guard, the spigot guard further including:

a first side spigot guard;

a second side spigot guard; and a spigot cross guard extending between the first side spigot guard and the second side spigot guard.

15. The insulating container of claim 14, wherein the first side spigot guard and the second side spigot guard a integrally formed with the base.

16. The insulating container of claim 14, wherein the spigot cross guard is formed separately from the base and is connected to the base via a plurality of fasteners.

17. The insulating container of claim 14, wherein the spigot cross guard forms a handle on the insulating container.

18. The insulating container of claim 14, further including a lid configured to mate with the base and cover the opening formed at the second end of each side of the plurality of sides of the sidewall structure.

19. The insulating container of claim 18, wherein the lid is hingedly connected to the base and is removeable from the base.

* * * * *